United States Patent [19]

Nakajima et al.

[11] Patent Number: 4,983,859

[45] Date of Patent: Jan. 8, 1991

[54] MAGNETIC DEVICE FOR HIGH-VOLTAGE PULSE GENERATING APPARATUSES

[75] Inventors: Shin Nakajima, Kumagaya; Akira Yamataka, Saitama; Hideaki Shimizu, Kumagaya; Kiyotaka Yamauchi, Kumagaya; Shunsuke Arakawa, Kumagaya, all of Japan

[73] Assignee: Hitachi Metals, Ltd., Tokyo, Japan

[21] Appl. No.: 396,709

[22] Filed: Aug. 22, 1989

[30] Foreign Application Priority Data

Aug. 25, 1988 [JP] Japan ..... 63-211353

[51] Int. Cl.[5] ..... H01F 27/08

[52] U.S. Cl. ..... 307/419; 336/55

[58] Field of Search ..... 307/419, 401, 420, 421; 328/39; 336/55

[56] References Cited

U.S. PATENT DOCUMENTS

| | | | |
|---|---|---|---|
| 3,902,146 | 8/1975 | Muralidharan | 336/60 |
| 4,207,550 | 6/1980 | Daikoku et al. | 336/60 |
| 4,431,980 | 2/1984 | Ikegawa et al. | 336/60 |
| 4,602,177 | 7/1986 | Eckels et al. | 310/57 |
| 4,871,925 | 10/1989 | Yamauchi et al. | 307/415 |

FOREIGN PATENT DOCUMENTS

| | | |
|---|---|---|
| 63-211608 | 2/1988 | Japan . |
| 1453154 | 10/1976 | United Kingdom . |

OTHER PUBLICATIONS

"A Multipurpose 5-MEV Linear Induction Accelerator" by D. L. Birx et al., 1984 IEEE, pp. 186–190.

*Primary Examiner*—A. D. Pellinen
*Assistant Examiner*—Jeffrey A. Gaffin
*Attorney, Agent, or Firm*—Sughrue, Mion, Zinn, Macpeak & Seas

[57] ABSTRACT

A magnetic device for high-voltage pulse generating apparatuses including (a) at least one cylindrical conductor for defining a cavity, the cylindrical conductor being provided with input and output terminals and an inlet and an outlet for a coolant; (b) at least one sealing member fixed to the cylindrical conductor; (c) a plurality of wound magnetic cores each composed of a magnetic ribbon laminated with an insulating layer, the wound magnetic cores being fixed to the cylindrical conductor with such an interval as to provide a certain space between the adjacent wound magnetic cores; and (d) an outer ring member disposed between each of the magnetic cores and the cylindrical conductor and having at least one path for permitting the coolant to flow therethrough, whereby the coolant flows in a radial or circumferential direction of each wound magnetic core in each space between the adjacent wound magnetic cores.

11 Claims, 26 Drawing Sheets

MAGNETIC DEVICE FOR HIGH-VOLTAGE PULSE GENERATING APPARATUSES

BACKGROUND OF THE INVENTION

The present invention relates to magnetic devices such as saturable reactors, transformers, choke coils, accelerator cells, etc. for use in high-voltage pulse generating circuits used in pulse discharge gas lasers such as excimer lasers and copper vapor lasers, accelerators, etc.

One example of high-voltage pulse generating circuits for excimer lasers, one type of pulse discharge gas lasers, is shown in FIG. 27. The circuit of FIG. 27 is called a magnetic pulse compression circuit. DC voltage $V_i$ is applied between input terminals 201 and 202 in the polarity shown in the figure, and during the period in which a thyratron 204 is off, a main capacitor 206 is charged at a voltage $V_1$ of about several tens kV in the polarity shown in the figure. In this circuit, a voltage $V_2$ is applied between the terminals of a capacitor 207 after the thyratron 204 is turned on, and a saturable reactor 208 functions to compress the voltage $V_2$ to a voltage $V_0$ having a pulse width of about 100 ns necessary for the oscillation of the excimer laser. In this sense, this saturable reactor 208 may be called a magnetic switch. Incidentally, the pulse width of the voltage $V_2$ applied to both terminals of the capacitor 207 depends on a time constant determined by capacitances of the capacitors 206 and 207 and an inductance of an inductor 205. 203, 212 denote inductances for charging the main capacitors 206, and 211 denotes electrodes for the discharge of the excimer laser.

In this circuit, since the pulse compression is achieved by using the saturable reactor 208, peak losses generated at the time of turn-on of the thyratron 204 and losses due to after current and inverse current can be suppressed, thereby contributing to high repetition rate, large output and long service life of the excimer laser.

FIG. 28 shows another example of high-voltage pulse generating circuits for excimer lasers, which is called a magnetic assist circuit. As in FIG. 27, DC voltage $V_i$ is applied between input terminals 221 and 222 in the polarity shown in the figure, and during the period in which a thyratron 224 is off, a main capacitor 226 is charged at a voltage $V_l$ of about several tens kV in the polarity shown in the figure. In this circuit, a saturable reactor 228 functions to delay the rise of the current $i_1$, thereby decreasing switching losses generated at the time of turn-on of the thyratron 224. Likewise the circuit shown in FIG. 27, the circuit of FIG. 28 contributes to achieve the high repetition rate, large output and long service life of the excimer lasers.

As a further example of high-voltage pulse generating circuits, a circuit used in a linear induction accelerator, which is an accelerator of electron beam, etc., is shown in FIG. 29. As in FIG. 27, DC voltage $V_i$ is applied between input terminals 241 and 242 in the polarity shown in the figure, and during the period in which a thyratron 244 is off, a main capacitor 246 is charged at a voltage $V_1$ of about several tens kV in the polarity shown in the figure. In this circuit, a transformer 253 functions to increase the voltage, and by setting the number of turns larger in a secondary winding 255 than in a primary winding 254, a voltage pulse having a larger wave height than that of the input voltage $V_i$ can be generated between both terminals of the secondary winding 255. Capacitors 247, 249 and saturable reactors 248, 256 constitute two steps of magnetic pulse compression circuits, which usually function to compress the voltage $V_2$ having a pulse width of several $\mu$m between the terminals of the capacitor 247 to a voltage $V_4$ having a pulse width of about 100 ns or less between both terminals of a load 257. The load 257 is a conversion element called an accelerator cell for accelerating electron beams, etc. The accelerator cell functions like a kind of a transformer comprising a magnetic core. Incidentally, the details of high-voltage pulse generating apparatuses in a linear induction accelerator and the accelerator cells are shown in, for instance, D. L. Brix, S. A. Hawkins, S. E. Poor, L. L. Reginato and M. W. Smith, "A Multipurpose 5-MeV Linear Induction Accelerator," IEEE Conference Record of 1984, Power Modulator Symposium, pp. 186–190.

The magnetic device used for the above applications is usually a wound magnetic core composed of an amorphous magnetic ribbon and an insulation film or coating laminated alternately to have a breakdown voltage of about several tens kV or more. In the wound magnetic core, axial ends of the insulation film extend from those of the amorphous magnetic ribbon to prevent the insulation breakdown of the wound magnetic core due to discharge on the axial end surfaces. When it is used at a high repetition rate of several hundred Hz or more, the wound magnetic core is disposed such that it can be cooled by a coolant such as a compressed air, a freon gas, an insulating oil, etc.

FIG. 30 shows a saturable reactor capable of being operated at a high repetition rate, as one example of magnetic devices for high-voltage pulse generating apparatuses. In this figure, 1 denotes an input or output terminal, 2 a coaxial cylindrical conductor having an outer wall 2*a* and an inner wall 2*b*, 3 an output or input terminal, 4 an inlet for a coolant, 5 an outlet for a coolant, 6 a plurality of magnetic cores, 7 an insulating ring for fixing each magnetic core 6 to the inner or outer wall of the coaxial cylindrical conductor 2, and 11 an insulating seal member for providing insulation between the input and output terminals 1, 3 and for sealing a cavity defined by the inner and outer walls 2*a*, 2*b* of the coaxial cylindrical conductor 2. In this saturable reactor, the magnetic cores 6 are cooled by circulating a cooling oil by a pump (not shown).

FIG. 31 shows a transformer having a turn ratio of 1:1 as an example of transformers used in high-voltage pulse generating circuits. In this figure, 261 denotes a terminal common to primary and secondary windings of the transformer. One turn of the primary winding is constituted by the terminal 261, a cylindrical conductor 262, a rod conductor 263, a disc-shaped conductor 264, a rod conductor 265 and a primary winding end 266. On the other hand, one turn of the secondary winding is constituted by the terminal 261, the cylindrical conductor 262, a rod conductor 267, a disc-shaped conductor 268, a rod conductor 269 and a secondary winding end 270. Incidentally, a plurality of the magnetic cores 271 are fixed to the cylindrical conductor 262 by an insulating ring 272. In this transformer, the magnetic cores 271 are cooled by immersing the entire transformer in an oil bath.

FIG. 32 shows the structure of an accelerator cell used in the linear induction accelerator. An input winding having a turn number of 1 is constituted by terminals 281*a*, 281*b*, a coaxial cylindrical conductor 282 and terminals 283*a*, 283*b*, and an output winding having a turn number of 1 is constituted by terminals 291*a*, 291*b*, a coaxial cylindrical conductor 292 and a terminal 293. Incidentally, the terminals 283*a* and 283*b* and the terminals 291*a* and 291*b* are respectively connected electrically. A plurality of magnetic cores 286 are fixed to the coaxial cylindrical conductor 282 by insulating rings 287. The magnetic cores 286 are cooled by a cooling oil flowing from an inlet 296 to an outlet 297 in the direction shown by the arrow. 294 denotes a conical insulating seal member for sealing the high-voltage pulse generating circuit of the accelerator cell filled with an insulating oil from a space in which electron beams move.

In the above magnetic cores for high-voltage pulse generating apparatuses cooled by an insulating oil, heat spots tend to be generated inside the magnetic cores by magnetic core losses when a repetition rate is increased, for instance, to 1 kHz or more. As a result, the characteristics of the magnetic cores are deteriorated in a short period of time after starting the operation. In an extreme case, the magnetic properties of the magnetic cores at heat spots are drastically deteriorated, and their initial properties cannot be recovered after restart of the operation. Such deterioration of the magnetic properties due to the heat spots is remarkable particularly when the amorphous magnetic ribbon is used for constituting the magnetic cores.

OBJECT AND SUMMARY OF THE INVENTION

An object of the present invention is to provide a magnetic device for high-voltage pulse generating apparatuses in which temperature increase is suppressed, thereby preventing the generation of heat spots in the magnetic cores.

Thus, the magnetic device for high-voltage pulse generating apparatuses according to one embodiment of the present invention comprises (a) a coaxial cylindrical conductor having an inner cylindrical wall and an outer cylindrical wall for defining a cavity therebetween, the coaxial cylindrical conductor being provided with input and output terminals and an inlet and an outlet for a coolant; (b) an insulating sealing member fixed to the coaxial cylindrical conductor for sealing the cavity; and (c) a plurality of wound magnetic cores each composed of a magnetic ribbon laminated with an insulating layer, the wound magnetic core being fixed in the cavity via outer insulating ring members and inner insulating ring members with such an interval as to provide a certain space between the adjacent wound magnetic cores, the inner and outer insulating ring members alternately having paths for permitting the coolant to flow therethrough, whereby to coolant flows in a radial direction of each wound magnetic core in each space between the adjacent wound magnetic cores.

The magnetic device for high-voltage pulse generating apparatuses according to another embodiment of the present invention comprises (a) a coaxial cylindrical conductor having an inner cylindrical wall and an outer cylindrical wall for defining a cavity therebetween, the coaxial cylindrical conductor being provided with input and output terminals and an inlet and an outlet for a coolant; (b) an insulating sealing member fixed to the coaxial cylindrical conductor for sealing the cavity; (c) a plurality of magnetic core assemblies each composed of a plurality of wound magnetic cores disposed radially with a certain gap between radially adjacent wound magnetic cores, each of the wound magnetic cores being composed of a magnetic ribbon laminated with an insulating layer, and the magnetic core assemblies being fixed in the cavity with such an interval as to provide a certain space between axially adjacent magnetic core assemblies; and (d) a plurality of disc-shaped insulating coolant guide members each having a plurality of apertures, the apertures being positioned between radially adjacent gaps of the magnetic core assemblies, whereby the coolant flows in a radial direction of each wound magnetic core in each space between the axially adjacent magnetic core assemblies.

The magnetic device for high-voltage pulse generating apparatuses according to a further embodiment of the present invention comprises (a) a coaxial cylindrical conductor having an inner cylindrical wall and an outer cylindrical wall for defining a cavity therebetween, the coaxial cylindrical conductor being provided with input and output terminals and an inlet and an outlet for a coolant; (b) an insulating sealing member fixed to the coaxial cylindrical conductor for sealing the cavity; (c) a plurality of wound magnetic cores each composed of a magnetic ribbon laminated with an insulating layer, the wound magnetic cores being fixed in the cavity via outer insulating ring members and inner insulating ring members with such an interval as to provide a certain space between the adjacent wound magnetic cores, the inner and outer insulating ring members alternately having paths for permitting the coolant to flow therethrough: and (d) inner and outer insulating coolant guide members disposed in each space between the adjacent wound magnetic cores, each of the inner and outer insulating coolant guide members having a notch for permitting the coolant to pass therethrough, the notches of the inner and outer insulating coolant guide members being located in each space substantially at diametrically opposite positions, whereby the coolant flows along the circumferential direction of each wound magnetic core.

The magnetic device for high-voltage pulse generating apparatuses according to a still further embodiment of the present invention comprises (a) inner and outer cylindrical conductors disposed coaxially for defining a cavity therebetween, said outer cylindrical conductor being provided with input and output terminals and an inlet and an outlet for a coolant; (b) a pair of insulating sealing members fixed to said inner and outer cylindrical conductors for sealing said cavity; (c) a plurality of wound magnetic cores each composed of a magnetic ribbon laminated with an insulating layer, said wound magnetic cores being fixed in said cavity via outer insulating ring members and inner insulating ring members with such an interval as to provide a certain space between the adjacent wound magnetic cores, said inner and outer insulating ring members alternately having paths for permitting said coolant to flow therethrough; and (d) inner and outer insulating coolant guide members disposed in each space between the adjacent wound magnetic cores, each of said inner and outer insulating coolant guide members having a notch for permitting said coolant to pass therethrough, said notches of the inner and outer insulating coolant guide members being located in each space substantially at diametrically opposite positions, whereby said coolant flows along the circumferential direction of each wound magnetic core.

The magnetic device for high-voltage pulse generating apparatuses according to a still further embodiment of the present invention comprises (a) a cylindrical casing provided with an inlet and an outlet for a coolant; (b) a pair of insulating plates fixed to both ends of the cylindrical casing for defining a cavity, each of the insulating plates being provided with at least one terminal for a winding; (c) an inner insulating cylindrical member extending axially in the cylindrical casing and having a plurality of holes extending axially; (d) a plurality of wound magnetic cores each composed of a magnetic ribbon laminated with an insulating layer, the wound magnetic cores being fixed to the inner insulating cylindrical member with a certain space between the adjacent wound magnetic cores; (e) a plurality of outer insulating ring members each disposed between the wound magnetic core and the cylindrical conductor, the outer insulating ring members being provided with a plurality of holes extending axially; (f) a plurality of outer insulating ring spacers each having a pair of notches positioned diametrically opposite to each other; and (g) at least one winding having a plurality of turns extending through the holes of the inner insulating cylindrical member and the outer insulating ring members, whereby a coolant introduced into the cavity through the inlet flows circumferentially from one notch to the other notch of the outer insulating ring spacer in each space between the adjacent wound magnetic cores.

BRIEF DESCRIPTION OF THE DRAWINGS

FIG. 7 B is a side view of the disc-shaped insulating coolant guide member of FIG. 7 A;

DETAILED DESCRIPTION OF THE INVENTION

Figure 1:
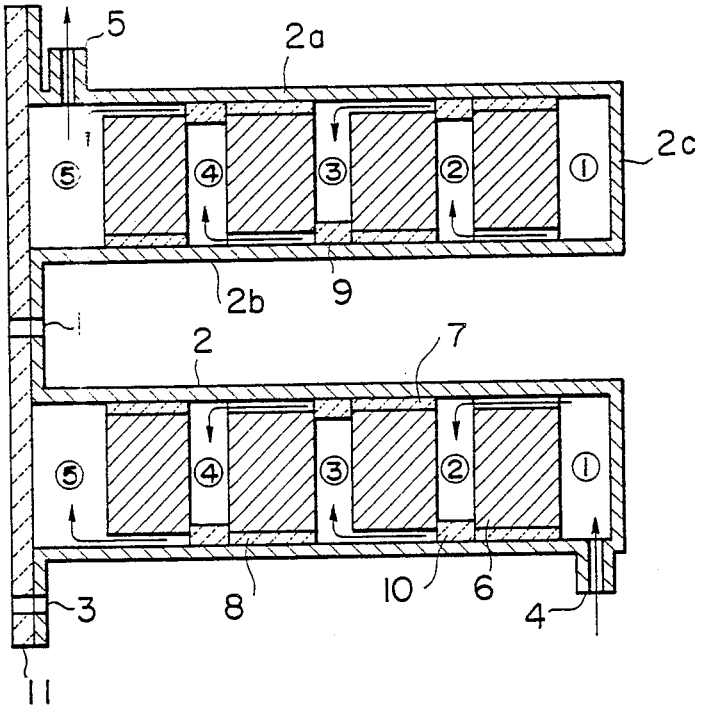
FIG. 1 is a cross-sectional view showing the saturable reactor for high-voltage pulse generating apparatuses according to one embodiment of the present invention.

FIG. 1 shows a saturable reactor as a magnetic device for high-voltage pulse generating apparatuses according to one embodiment of the present invention. In FIG. 1, 1 denotes an input or output terminal, 2 a coaxial cylindrical conductor having an outer wall 2*a*, an inner wall 2*b* and an end wall 2*c* for defining a cavity, 3 an output or input terminal, 4 an inlet for a coolant, 5 an outlet for a coolant, 6 a plurality of wound magnetic cores each constituted by a Co-base amorphous magnetic ribbon, for instance, and an insulating tape such as a polyethylene terephthalate film tape such as Mylar film tape, 7 and 8 insulating ring members for fixing the magnetic core 6 and shutting the flow of a coolant, 9 and 10 insulating coolant guide ring members for keeping the adjacent magnetic cores separate from each other and for permitting the coolant to pass therethrough such that the end surfaces of the magnetic cores can be uniformly cooled by the coolant, and 11 an insulating seal member for electrically insulating the input and output terminals 1, 3 and for sealing the cavity defined by the inner, outer and end walls 2a–2c of the coaxial cylindrical conductor 2. In this saturable reactor, a coolant such as a cooling oil is introduced into the cavity of the coaxial cylindrical conductor through the inlet 4, and it flows in the cavity along the course of ①→②→③→④→⑤. While uniformly cooling the end surfaces of each magnetic core 6, the coolant is discharged through the outlet 5 and recycled by a pump (not shown).

In the present invention, the end surfaces of the magnetic cores 6 are uniformly cooled. In the case of a wound magnetic core, particularly an interlaminar insulation-type wound magnetic core as in this embodiment, the thermal coefficient of the magnetic core is extremely smaller in the radial direction of the magnetic core than in the axial direction of the magnetic core. Accordingly, to increase a cooling efficiency, it is important to uniformly cool the end surfaces of each magnetic core.

Figure 2:
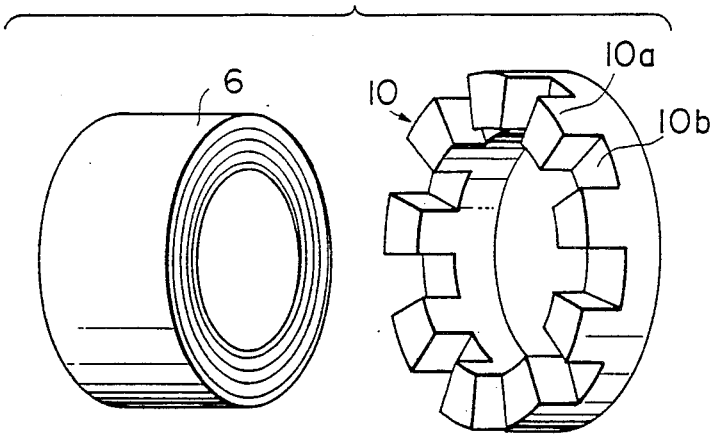
FIG. 2 is a perspective view showing one magnetic core and an insulating coolant guide member used in the present invention.
Figure 3:
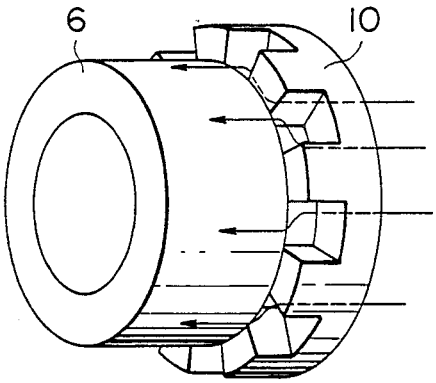
FIG. 3 is a perspective view showing a magnetic core and an insulating coolant guide member assembled together.

FIG. 2 shows one example of an insulating coolant guide ring member 10 disposed between the adjacent magnetic cores 6 for uniformly cooling the end surfaces of each magnetic core 6. The magnetic core 6 and the insulating coolant guide ring member 10 are assembled together in the saturable reactor of FIG. 1 as shown in FIG. 3. Projections 10a of the insulating coolant guide ring member 10 are directed opposite to the inlet 4, namely toward the outlet 6 in FIG. 1. In other words, the insulating coolant guide ring member 10 has a plurality of notches 10b which provide a plurality of spaces or gaps when assembled with the magnetic core 6, thereby permitting the coolant to pass therethrough. Accordingly, the cooling oil flows as shown by the arrow in FIG. 3 from the inside of the magnetic core 6 to the outside of the magnetic core 6 and then along the circumferential surface of the magnetic core 6. Since the inner surface of the magnetic core 6 is fixed to the insulating ring member 7, the cooling oil does not pass through the inside of the magnetic core 6. Thus, the cooling oil flows in the radial direction of the magnetic core 6 from inside to outside, and the end surfaces of each magnetic core 6 is uniformly cooled. The cooling oil then flows over the circumferential surface of each magnetic core 6 and enters into a subsequent cavity defined by the adjacent magnetic cores 6, 6 and the coaxial cylindrical conductor 2. The cooling oil then flows from the outside toward the inside of the magnetic core 6. This process is ②→③ as shown in FIG. 1.

The insulating coolant guide ring member 9 also has essentially the same shape as the insulating coolant guide ring member 10 shown in FIG. 2, and the insulating coolant guide ring member 9 has an outer diameter slightly larger than the inner diameter of the magnetic core 6 and an inner diameter slightly smaller than the inner diameter of the magnetic core 6. The projections of the insulating coolant guide ring member 9 are directed opposite to the inlet 4, namely toward the outlet 5 in FIG. 1. Incidentally, since the outer surface of the magnetic core 6 is fixed to the insulating ring member 8, the cooling oil does not flow along the outer surface of the magnetic core 6. Because of this structure, the cooling oil can flow through notches defined by a plurality of projections, and the cooling oil flows from the outer side toward the inner side of the magnetic core 6 in a cavity, thereby uniformly cooling the end surfaces of the magnetic cores 6. The cooling oil then flows along the inner surface of the magnetic core 6 and then from inside to outside in a subsequent space. This flow of the cooling oil is shown by ③→④ in FIG. 1.

Figure 30:
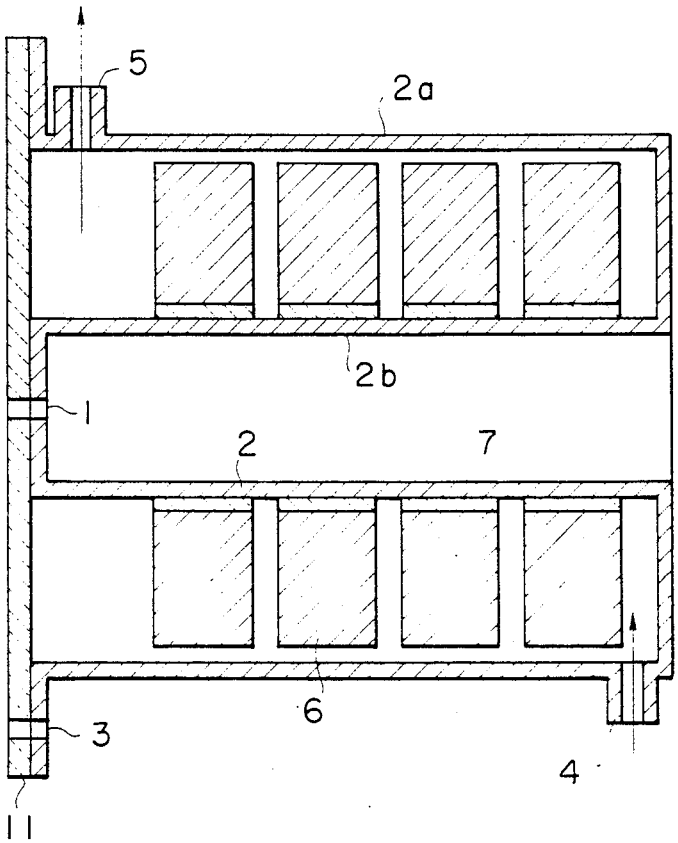
FIG. 30 PRIOR ART
FIG. 30 is a cross-sectional view showing a conventional saturable reactor for high-voltage pulse generating apparatuses.

With a silicone oil having a viscosity of 5 $mm^2/S$ as a cooling oil, the variation of a compression ratio with time was measured on the saturable reactor for high-voltage pulse generating apparatuses in this embodiment shown in FIG. 1 and the conventional one shown in FIG. 30. In this measurement, both saturable reactors were assembled in a KrF excimer laser apparatus including the circuit shown in FIG. 27. Incidentally, the compression ratio is a value obtained by dividing the pulse width of voltage $V_2$ between the terminals of the capacitor 207 generated after the turn-on of the thyratron 204 by the pulse width of voltage $V_0$ between the terminals of the capacitor 209. The results are shown in Table 1.

TABLE 1

| | Compression Ratio | | | | |
|---|---|---|---|---|---|
| | At Start | After 30 sec | After 60 sec | After 120 sec | After 300 sec |
| Saturable Reactor of the Present Invention* | 5.5 | 5.3 | 5.2 | 5.1 | 5.1 |
| Conventional Saturable Reactor** | 5.5 | 5.2 | 4.6 | 4.3 | 3.9 |

Note:
*Shown in FIG. 1.
**Shown in FIG. 30.

Experimental Conditions:
Input: $V_i$=DC30 kV.
Capacitance=15 nF for capacitors 206, 207, 209.
Saturable reactor (in FIGS. 1 and 30).
Magnetic ribbon of each magnetic core:
Co-base amorphous magnetic ribbon.
The number of magnetic cores: 4.
Effective cross section=$1.2\times10^{-1}$ $m^2$ for each magnetic core.
Mean magnetic path length: $380\times10^{-3}$ m.
Repetition rate: 1 kHz.

In the present invention, extremely small variation of the compression ratio with time is obtained, so that the saturable reactor shows sufficient characteristics for practical use. On the other hand, in the conventional saturable reactor shown in FIG. 30, the saturation magnetic flux density of the magnetic cores decreases under the influence of heat spots generated mainly inside the magnetic cores, so that the compression ratio is drastically decreased.

With the same apparatuses and the same conditions as in Table 1, the deterioration of properties after repeated operations was evaluated. In this experiment, each saturable reactor was operated for 5 minutes, cooled for a sufficient period and then operated again, and this process was repeated. At the time of each restart, the compression ratio was measured. The results are shown in Table 2.

TABLE 2

| Number of Operation | Compression Ratio 1 | 10 | 20 | 30 | 100 |
|---|---|---|---|---|---|
| Saturable Reactor of the Present Invention* | 5.5 | 5.5 | 5.5 | 5.5 | 5.5 |
| Conventional Saturable Reactor** | 5.5 | 5.4 | 5.2 | 4.9 | 4.2 |

Note:
*Shown in FIG. 1.
**Shown in FIG. 30.

Experimental Conditions:
Input: $V_i$=DC 30 kV.
Capacitance=15 nF for capacitors 206, 207, 209.
Saturable reactor (in FIGS. 1 and 30).
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m.
Repetition rate: 1 kHz.
Operation time in each cycle: 5 minutes.

In the present invention, the compression ratio does not depend on the number of operation, while in the conventional saturable reactor, the magnetic properties of the saturable reactor are deteriorated by heat spots generated during the operation.

Figure 4:
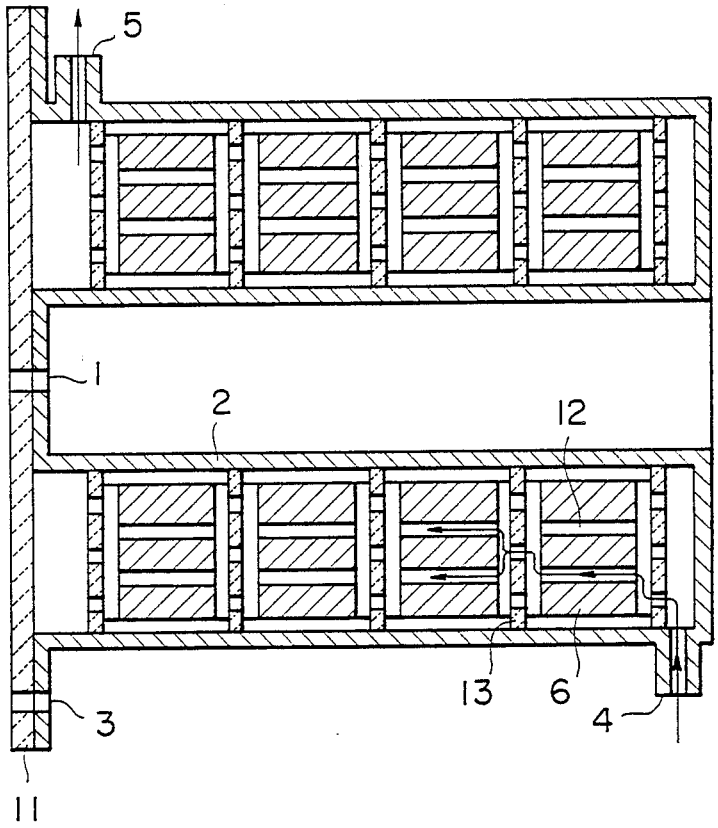
FIG. 4 is a cross-sectional view showing the saturable reactor for high-voltage pulse generating apparatuses according to another embodiment of the present invention.

FIG. 4 shows a saturable reactor for high-voltage pulse generating apparatuses according to one embodiment of the present invention. In FIG. 4, the same reference numerals are used for the same parts as in FIG. 1. Specifically, 1 denotes an input or output terminal, 2 a coaxial cylindrical conductor, 3 an output or input terminal, 4 an inlet for a coolant, 5 an outlet for a coolant, 6 a magnetic core assembly constituted by a plurality of wound magnetic cores each composed of an amorphous magnetic ribbon and an insulating tape such as a polyethylene terephthalate film tape, 11 a disc-shaped insulating member for electrically isolating the input and output terminals 1, 3 and for sealing a cavity defined by the coaxial cylindrical conductor 2, 12 a gap between the radially adjacent wound magnetic cores in each magnetic core assembly, and 13 an insulating coolant guide member for keeping the magnetic core assemblies separate from the coaxial cylindrical conductor and from each other and for guiding the coolant such that the end surfaces of the wound magnetic cores can be uniformly cooled by the coolant. In this saturable reactor, the coolant such as cooling oil is introduced into the cavity through the inlet 4, and it flows in the cavity along the course shown by the arrow. While uniformly cooling the end and circumferential surfaces of each wound magnetic core, the coolant is discharged through the outlet 5 and recycled by a pump (not shown).

Figure 5:
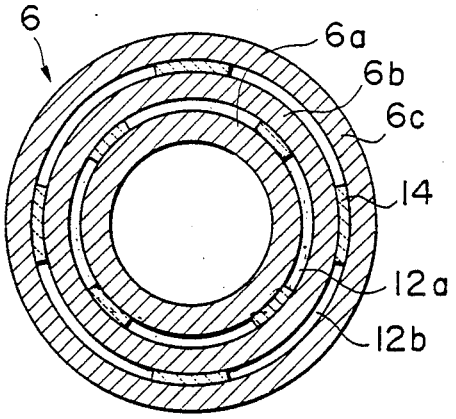
FIG. 5 is a cross-sectional view showing the magnetic core assembly constituted by a plurality of wound magnetic cores having different diameters according to a further embodiment of the present invention.

FIG. 5 shows the structure of the saturable magnetic core assembly used in FIG. 4. In this embodiment, the saturable magnetic core assembly is composed of 3 wound magnetic cores *6a, 6b, 6c* having different diameters and disposed concentrically, and insulating spacers 14 provided between the adjacent wound magnetic cores *6a* and *6b*, and *6b* and *6c* to provide annular spaces therebetween.

Figure 6:
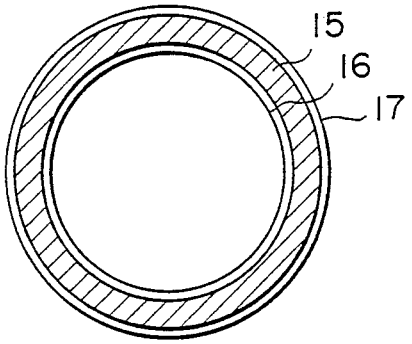
FIG. 6 is a cross-sectional view showing a wound magnetic core constituting the magnetic core assembly shown in FIG. 5.

FIG. 6 shows the structure of each wound magnetic core *6a, 6b, 6c* shown in FIG. 5. In this embodiment, the wound magnetic core 15 constituted by an amorphous magnetic ribbon insulated by a polyethylene terephthalate film tape laminated between the adjacent layers of the amorphous magnetic ribbon is supported by stainless steel rings 16 and 17 on its inner and outer surfaces to prevent its deformation.

Figure 7A:
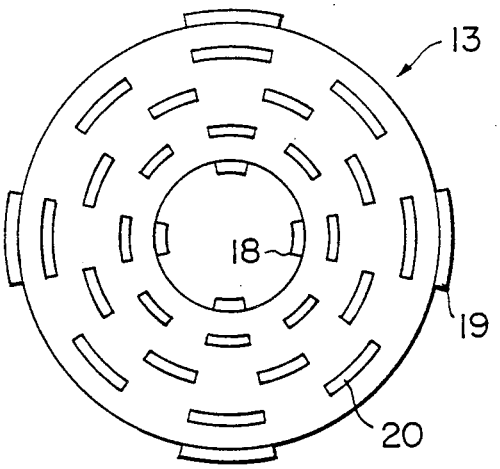
FIG. 7 A is a front view showing a disc-shaped insulating coolant guide member for preventing the contact of the magnetic core with the coaxial cylindrical conductor and for guiding the coolant to flow in a radial direction of each magnetic core the present invention.
Figure 7B:
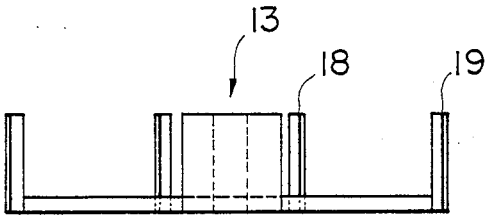

FIGS. 7 A and 7 B show the structure of the insulating coolant guide member for preventing the contact of the wound magnetic cores with the coaxial cylindrical conductor and from each other and for causing the cooling oil to flow radially on the end surfaces of each magnetic core. In this embodiment, 18 and 19 denote spacer portions for preventing the wound magnetic cores 6 from being brought into contact with the coaxial cylindrical conductor 2, and 20 denotes apertures for determining the flow direction of the cooling oil. A large number of apertures 20 are provided in the insulating coolant guide member 13 at such positions as to make sure that the end surfaces of the wound magnetic core are uniformly cooled. Because of the above structure, the surface area of the saturable magnetic core 6 can be made large, so that high cooling efficiency of the magnetic cores can be expected.

Figure 27:
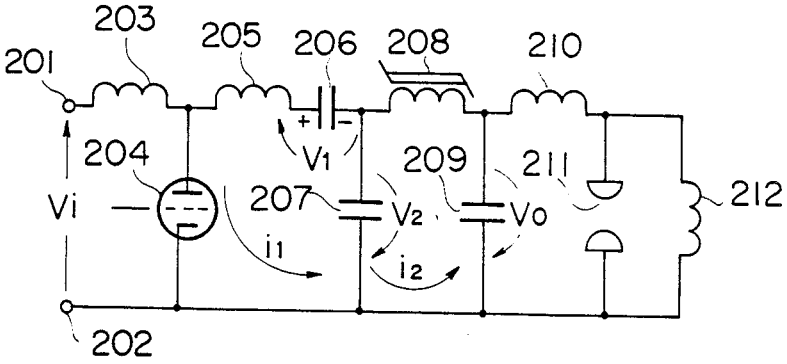
FIG. 27 PRIOR ART
FIG. 27 is a cross-sectional view showing an exciting circuit for an excimer laser which has a high-voltage pulse generating circuit for conducting magnetic pulse compression.

With a silicone oil having a viscosity of 5 $mm^2/S$ as a cooling oil, the variation of the compression ratio with time was measured on the saturable reactor in this embodiment shown in FIG. 4 and the conventional saturable reactor shown in FIG. 30, both of which were assembled in the KrF excimer laser having the circuit shown in FIG. 27. The results are shown in Table 3 together with experimental conditions.

TABLE 3

| | Compression Ratio At Start | After 30 sec | After 60 sec | After 120 sec | After 300 sec |
|---|---|---|---|---|---|
| Saturable Reactor of the Present Invention* | 5.5 | 5.4 | 5.3 | 5.3 | 5.3 |
| Conventional Saturable Reactor** | 5.5 | 5.2 | 4.6 | 4.3 | 3.9 |

Note:
*Shown in FIG. 4.
**Shown in FIG. 30.

Experimental Conditions:
Input: $V_i$=DC 30 kV.
Capacitance=15 nF for capacitors 206, 207, 209.
Saturable reactor (in FIGS. 4 and 30).
Magnetic ribbon of each magnetic core.
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m
Repetition rate: 1 kHz In the present invention, extremely small variation of the compression ratio with time is obtained, so that the saturable reactor shows sufficient characteristics for practical use. On the other hand, in the conventional saturable reactor, the saturation magnetic flux density of the magnetic core decreases under the influence of the heat spots generated mainly inside the magnetic cores, so that the compression ratio is drastically decreased.

Further, the decrease in the compression ratio is smaller in this embodiment (FIG. 4) than in the embodiment shown in FIG. 1, which means that the saturable reactor of FIG. 4 can be subjected to a higher repetition rate.

With the same apparatuses and the same conditions as in Table 3, the deterioration of properties after repeated operations was evaluated. In this experiment, the saturable reactor was operated for 5 minutes, cooled for a sufficient period and then operated again, and this process was repeated. At the time of each restart, the compression ratio was measured. The results are shown in Table 4.

TABLE 4

| Number of Operation | Compression Ratio 1 | 10 | 20 | 50 | 100 |
|---|---|---|---|---|---|
| Saturable Reactor of the Present Invention* | 5.5 | 5.5 | 5.5 | 5.5 | 5.5 |
| Conventional Saturable Reactor** | 5.5 | 5.4 | 5.2 | 4.9 | 4.2 |

Note:
*Shown in FIG. 4.
**Shown in FIG. 30.

Experimental Conditions:
Input: $V_i$=DC 30 kV.
Capacitance=15 nF for capacitors 206, 207, 209.
Saturable reactor (in FIGS. 4 and 30).
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m.
Repetition rate: 1 kHz.
Operation time in each cycle: 5 minutes.

Figure 8:
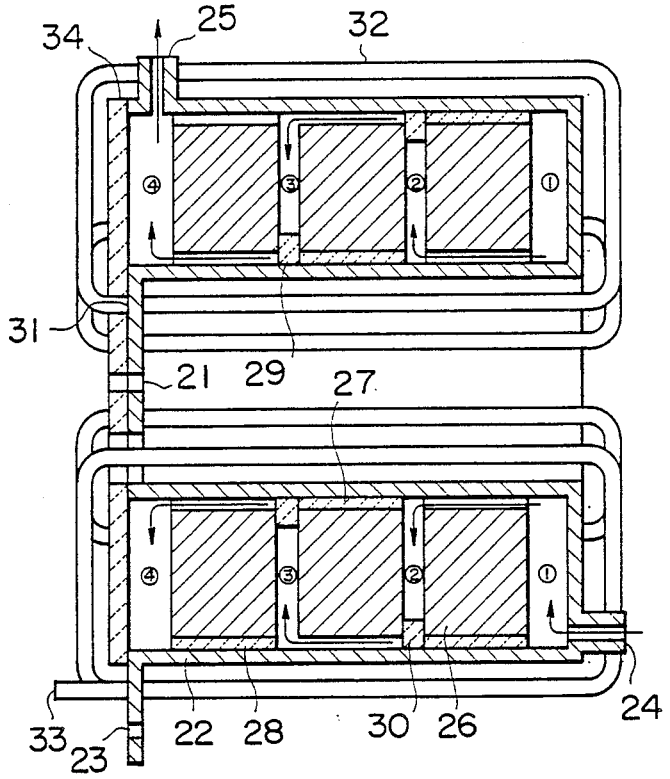
FIG. 8 is a cross-sectional view showing the transformer for high-voltage pulse generating apparatuses according to a further embodiment of the present invention.

FIG. 8 shows a transformer, as a magnetic device for high-voltage pulse generating apparatuses according to a further embodiment of the present invention. In FIG. 8, 21 denotes one end of a primary winding, 22 a coaxial cylindrical conductor constituting the primary winding having a turn number of 1, 23 the other end of the primary winding, 24 an inlet for a coolant, 25 an outlet for a coolant, 26 a plurality of wound magnetic cores each constituted by a Co-base amorphous magnetic ribbon, for instance, and an insulating tape such as a polyethylene terephthalate film tape, 27 and 28 insulating ring members for fixing the magnetic cores 26 and shutting the flow of a coolant, 29 and 30 insulating coolant guide ring members for keeping the adjacent magnetic cores separate from each other and for permitting the coolant to pass therethrough such that the end surfaces of the magnetic cores can be uniformly cooled by the coolant, 31 one end of a secondary winding, 32 a conductor constituting the secondary winding having a turn number of 6, 33 the other end of the secondary winding, and 34 an insulating seal member for insulating one end of the primary winding from its other end and for sealing a cavity defined by the primary winding. In this structure, the primary winding end 21 and the secondary winding end 31 are connected. Further, this transformer includes insulating ring members 29, 30 having substantially the same structures as those shown in FIGS. 2 and 3. In this transformer, a coolant such as a cooling oil is introduced into the cavity of the coaxial cylindrical conductor (primary winding) through the inlet 24, and it flows in the cavity along the course of ①→②→③→④. While uniformly cooling the end surfaces of each magnetic core 26, the coolant is discharged through the outlet 25 and recycled by a pump (not shown).

Figure 31:
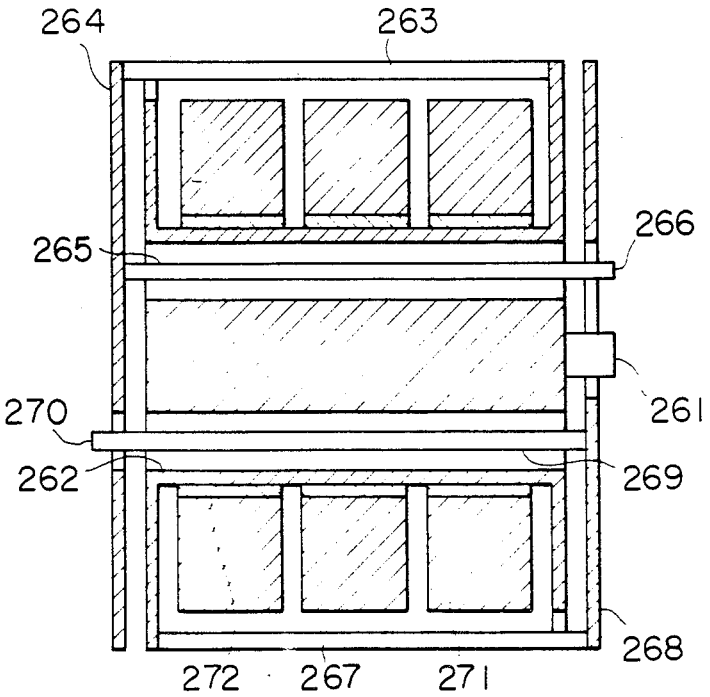
FIG. 31 PRIOR ART
FIG. 31 is a cross-sectional view showing a conventional transformer for high-voltage pulse generating apparatuses.

With a silicone oil having a viscosity of 5 $mm^2/S$ as a cooling oil, the variation of a magnetic core loss with time was measured on the transformer for high-voltage pulse generating apparatuses in this embodiment shown in FIG. 8 and the conventional one shown in FIG. 31. Incidentally, the magnetic core loss is expressed as 1.00 at start, and the magnetic core loss after certain number of operations is expressed by a ratio relative to 1.00. The results are shown in Table 5.

TABLE 5

| Number of Operation | Magnetic Core Loss 1 | 10 | 20 | 50 | 100 | 500 |
|---|---|---|---|---|---|---|
| Transformer of the Present Invention* | 1.00 | 1.02 | 1.02 | 1.03 | 1.03 | 1.05 |
| Conventional Transformer** | 1.00 | 1.06 | 1.09 | 1.17 | 1.24 | 1.38 |

Note:
*Shown in FIG. 8.
**Shown in FIG. 31.

Experimental Conditions:
Transformer (in FIGS. 8 and 31).
Magnetic ribbon of each magnetic core:
Fe-base amorphous magnetic ribbon.
The number of magnetic cores: 3.
Effective cross section=$1.5\times10^{-3}$ $m^2$ for each magnetic core.
Mean magnetic path length: $380\times10^{-3}$ m.
Operational magnetic flux density: 1.8 T.
Full width at half maxima: 1 μs.
Repetition rate: 1 kHz.
Operation time in each cycle: 5 minutes.

In the present invention, sufficiently small variation of the magnetic core loss with time is obtained, so that the transformer shows sufficient characteristics for practical use. On the other hand, in the conventional transformer, the loss of the magnetic core drastically increases under the influence of heat spots generated mainly inside the magnetic cores.

Figure 9:
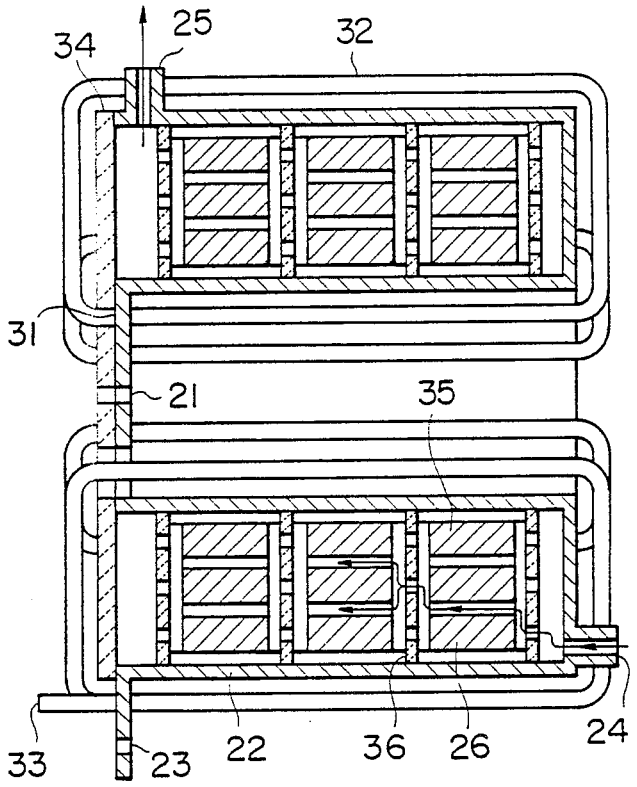
FIG. 9 is a cross-sectional view showing the transformer for high-voltage pulse generating apparatuses according to a still further embodiment of the present invention.

FIG. 9 shows a transformer, as a magnetic device for high-voltage pulse generating apparatuses according to a still further embodiment of the present invention. In FIG. 9, the same reference numerals are assigned to the same parts as in FIG. 8. Specifically, 21 denotes one end of a primary winding having a turn number of 1, 22 a coaxial cylindrical conductor constituting the primary winding, 23 the other end of the primary winding, 24 an inlet for a coolant, 25 an outlet for a coolant, 26 a plurality of wound magnetic core assemblies each constituted by wound magnetic cores 35 composed of an Fe-base amorphous magnetic ribbon, for instance, and an insulating tape such as a polyethylene terephthalate film tape, 31 one end of a secondary winding, 32 a conductor constituting the secondary winding having a turn number of 6, 33 the other end of the secondary winding, 34 an insulating seal member for insulating one end of the primary winding from its other end and for sealing a cavity defined by the primary winding, and 36 an insulating coolant guide member for keeping the magnetic cores separate from the coaxial cylindrical conductor 22 and from each other and for permitting the coolant to pass therethrough such that the end surfaces of the wound magnetic cores can be uniformly cooled by the coolant. In this structure, the primary winding end 21 and the secondary winding end 31 are connected. Incidentally, in this transformer, the magnetic core assembly 26 and a disc-shaped insulating coolant guide member 36 have substantially the same structures as those shown in FIGS. 5–7. In this transformer, a coolant such as a cooling oil is introduced into the cavity of the coaxial cylindrical conductor (primary winding) through the inlet 24, and it flows in the cavity along the course shown by the arrow. While uniformly cooling the end surfaces of each magnetic core 26, the coolant is discharged through the outlet 25 and recycled by a pump (not shown).

With a silicone oil having a viscosity of 5 $mm^2/S$ as a cooling oil, the variation of a magnetic core loss with time was measured on the transformer for high-voltage pulse generating apparatuses in this embodiment shown in FIG. 9 and the conventional one shown in FIG. 31. Incidentally, the magnetic core loss is expressed as 1.00 at start, and the magnetic core loss after a certain number of operations is expressed by a ratio relative to 1.00. The results are shown in Table 6.

TABLE 6

| Number of Operation | Magnetic Core Loss | | | | | |
|---|---|---|---|---|---|---|
| | 1 | 10 | 20 | 50 | 100 | 500 |
| Transformer of the Present Invention* | 1.00 | 1.00 | 1.01 | 1.02 | 1.02 | 1.02 |
| Conventional Transformer** | 1.00 | 1.06 | 1.09 | 1.17 | 1.24 | 1.38 |

Note:
*Shown in FIG. 9.
**Shown in FIG. 31.

Experimental Conditions:
Transformer (in FIGS. 9 and 31).
Magnetic ribbon of each magnetic core:
Fe-base amorphous magnetic ribbon.
The number of magnetic cores: 3.
Effective cross section $=1.5\times10^{-3}$ $m^2$ for each magnetic core.
Mean magnetic path length: $380\times10^{-3}$ m.
Operational magnetic flux density: 1.8 T.
Full width at half maxima: 1 $\mu$s.
Repetition rate: 1 kHz.
Operation time in each cycle: 5 minutes.

In the present invention, sufficiently small variation of the magnetic core loss with time is obtained, so that the transformer shows sufficient characteristics for practical use. On the other hand, in the conventional transformer, the loss of the magnetic cores drastically increases under the influence of heat spots generated mainly inside the magnetic cores.

Further, the variation of the magnetic core loss with time is smaller in this embodiment shown in FIG. 9 than in the embodiment shown in FIG. 8, which means that the transformer of FIG. 9 can advantageously be subjected to a higher repetition rate.

Figure 10:
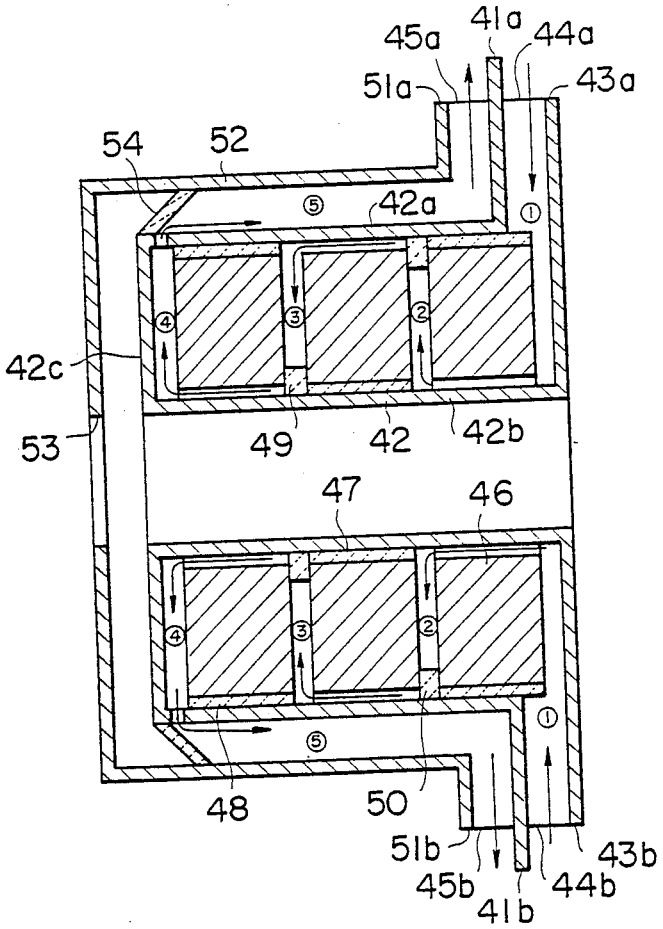
FIG. 10 is a cross-sectional view showing the accelerator cell according to a still further embodiment of the present invention.

FIG. 10 shows an accelerator cell, as a magnetic device for high-voltage pulse generating apparatuses according to a still further embodiment of the present invention. In FIG. 10, 41*a*, 41*b* denote one terminal of an input winding, 42 a coaxial cylindrical conductor constituting the input winding having a turn number of 1, which has an outer wall 42*a*, an inner wall 42*b* and an end wall 42*c* for defining a cavity, 43*a*, 43*b* a ground terminal of the input winding, 44*a*, 44*b* an inlet for a coolant, 45*a*, 45*b* an outlet for a coolant, 46 a plurality of wound magnetic cores each constituted by an Fe-base amorphous magnetic ribbon, for instance, and an insulating tape such as a polyethylene terephthalate film tape, 47 and 48 insulating ring members for fixing the magnetic cores 46 and shutting the flow of a coolant, 51*a*, 51*b* a ground terminal of an output winding, 52 a coaxial cylindrical conductor constituting the output winding having a turn number of 1, 53 one terminal of the output winding, and 54 a conical insulating seal member for sealing a space between the outer wall 42*a* of the coaxial cylindrical conductor 42 and the coaxial cylindrical conductor 52. In this structure, the ground terminal 43*a*, 43*b* of the input winding 42 and the ground terminal 51*a*, 51*b* of the output terminal 52 are connected. In this accelerator cell, a coolant such as a cooling oil is introduced into the cavity defined by the inner and outer walls 42*a*, 42*b* of the coaxial cylindrical conductor 42 through the inlet 44*a*, 44*b*, and it flows in the cavity along the course of ①→②→③→④→⑤. While uniformly cooling the end surfaces of each magnetic core 46, the coolant is discharged through the outlet 45*a*, 45*b* and recycled by a pump (not shown).

Figure 32:
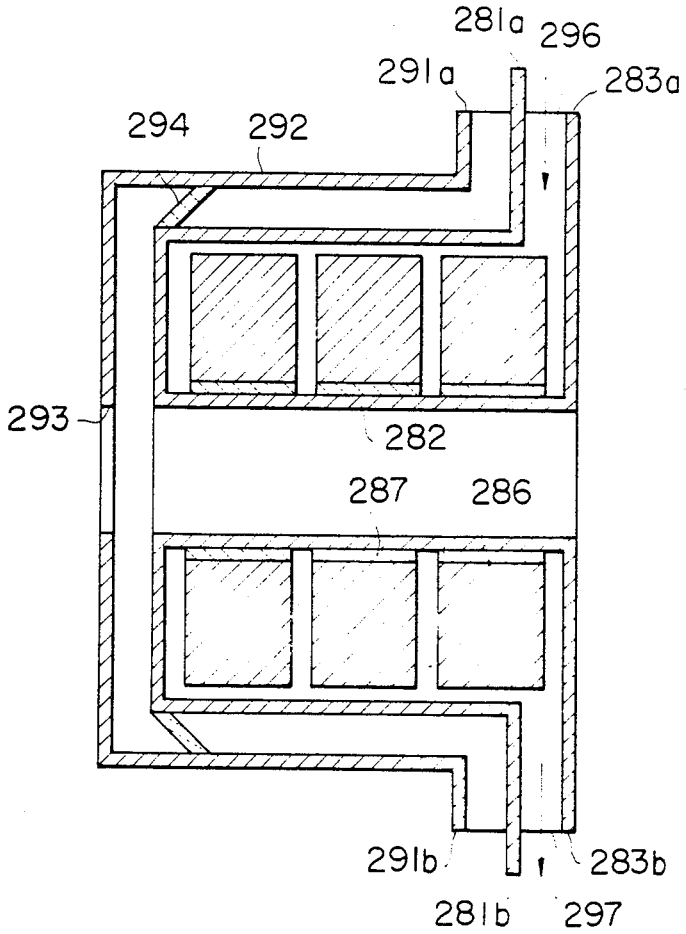
FIG. 32 PRIOR ART
FIG. 32 is a cross-sectional view showing a conventional accelerator cell.

With a silicone oil having a viscosity of 5 $mm^2/S$ as a cooling oil, the variation of a magnetic core loss with time was measured on the transformer for high-voltage pulse generating apparatuses in this embodiment shown in FIG. 10 and the conventional one shown in FIG. 32. Incidentally, the magnetic core loss is expressed as 1.00 at start, and the magnetic core loss after a certain number of operations is expressed by a ratio relative to 1.00. The results are shown in Table 7.

TABLE 7

| Number of Operation | Magnetic Core Loss | | | | |
|---|---|---|---|---|---|
| | 1 | 10 | 20 | 50 | 100 |
| Accelerator Cell of the Present Invention* | 1.00 | 1.04 | 1.07 | 1.09 | 1.12 |
| Conventional Accelerator Cell** | 1.00 | 1.11 | 1.22 | 1.37 | 1.54 |

Note:
*Shown in FIG. 10.
**Shown in FIG. 32.

Experimental Conditions:
Accelerator cell (in FIGS. 10 and 32).
Magnetic ribbon of each magnetic core:
Fe-base amorphous magnetic ribbon.
The number of magnetic cores: 3.
Effective cross section $=1.0\times10^{-3}$ $m^2$ for each magnetic core.
Mean magnetic path length: 1.57 m.
Operational magnetic flux density: 1.8 T.
Full width at half maxima: 50 ns.
Repetition rate: 100 Hz.
Operation time in each cycle: 1 minute.

In the present invention, sufficiently small variation of the magnetic core loss with time is obtained, so that the accelerator cell shows sufficient characteristics for practical use. On the other hand, in the conventional accelerator cell, the loss of the magnetic cores drastically increases under the influence of heat spots generated mainly inside the magnetic cores.

Figure 11:
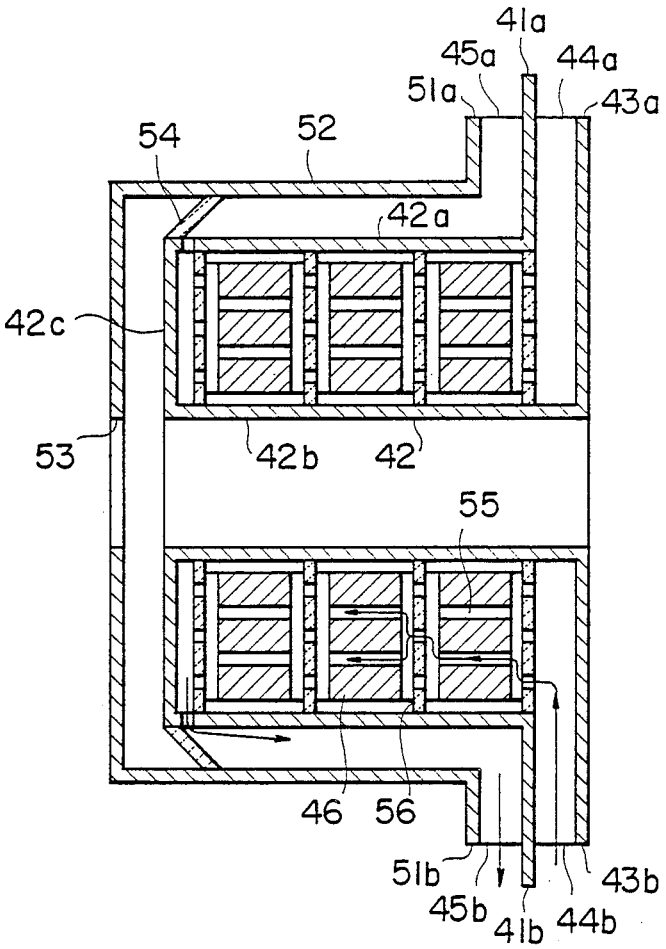
FIG. 11 is a cross-sectional view showing the accelerator cell according to a still further embodiment of the present invention.

FIG. 11 shows an accelerator cell, as a magnetic device for high-voltage pulse generating apparatuses according to a still further embodiment of the present invention. In FIG. 11, the same reference numerals are assigned to the same parts as in FIG. 10. Specifically, 41*a*, 41*b* denote one terminal of an input winding, 42*a* coaxial cylindrical conductor constituting the input winding having a turn number of 1, which has an outer wall 42*a*, an inner wall 42*b* and an end wall 42*c* for defining a cavity, 43*a*, 43*b* a ground terminal of the input winding, 44*a*, 44*b* an inlet for a coolant, 45*a*, 45*b* an outlet for a coolant, 46 a plurality of magnetic core assemblies each constituted by a plurality of wound magnetic cores composed of an Fe-base amorphous magnetic ribbon, for instance, and an insulating tape such as a polyethylene terephthalate film tape, 51*a*, 51*b* a ground terminal of an output winding, 52 a coaxial cylindrical conductor constituting the output winding having a turn number of 1, 53 one terminal of the output winding, 54 a conical insulating seal member for sealing a space between the outer wall 42*a* of the coaxial cylindrical conductor 42 and the coaxial cylindrical conductor 52, 56 a plurality of disc-shaped insulating coolant guide members each having a plurality of apertures positioned between the radial gaps of the magnetic core assembly to uniformly cool the end surfaces of the wound magnetic cores. In this structure, the ground terminal 43*a*, 43*b* of the input winding 42 and the ground terminal 51*a*, 51*b* of the output terminal 52 are connected. In this accelerator cell, a coolant such as a cooling oil is introduced into the cavity defined by the inner and outer walls 42*a*, 42*b* of the coaxial cylindrical conductor 42 through the inlet 44*a*, 44*b*, and it flows in the cavity along the course shown by the arrow. While uniformly cooling the end surfaces of each magnetic core 46, the coolant is discharged through the outlet 45*a*, 45*b* and recycled by a pump (not shown).

With a silicone oil having a viscosity of 5 $mm^2/S$ as a cooling oil, the variation of a magnetic core loss with time was measured on the transformer for high-voltage pulse generating apparatuses in this embodiment shown in FIG. 11 and the conventional one shown in FIG. 32. Incidentally, the magnetic core loss is expressed as 1.00 at start, and the magnetic core loss after a certain number of operations is expressed by a ratio relative to 1.00. The results are shown in Table 8.

TABLE 8

| Number of Operation | Magnetic Core Loss 1 | 10 | 20 | 50 | 100 |
|---|---|---|---|---|---|
| Accelerator Cell of the Present Invention* | 1.00 | 1.03 | 1.04 | 1.04 | 1.05 |
| Conventional Accelerator Cell** | 1.00 | 1.11 | 1.22 | 1.37 | 1.54 |

Note:
*Shown in FIG. 11.
**Shown in FIG. 32.

Experimental Conditions:
Accelerator cell (in FIGS. 11 and 32).
Magnetic ribbon of each magnetic core:
Fe-base amorphous magnetic ribbon.
The number of magnetic cores: 3.
Effective cross section $=1.0\times10^{-3}$ $m^2$ for each magnetic core.
Mean magnetic path length: 1.57 m.
Operational magnetic flux density: 1.8 T.
Full width at half maxima: 50 ns.
Repetition rate: 100 Hz.
Operation time in each cycle: 1 minute.

In the present invention, sufficiently small variation of the magnetic core loss with time is obtained, so that the accelerator cell shows sufficient characteristics for practical use. On the other hand, in the conventional accelerator cell, the loss of the magnetic cores drastically increases under the influence of heat spots generated mainly inside the magnetic cores.

Figure 12:
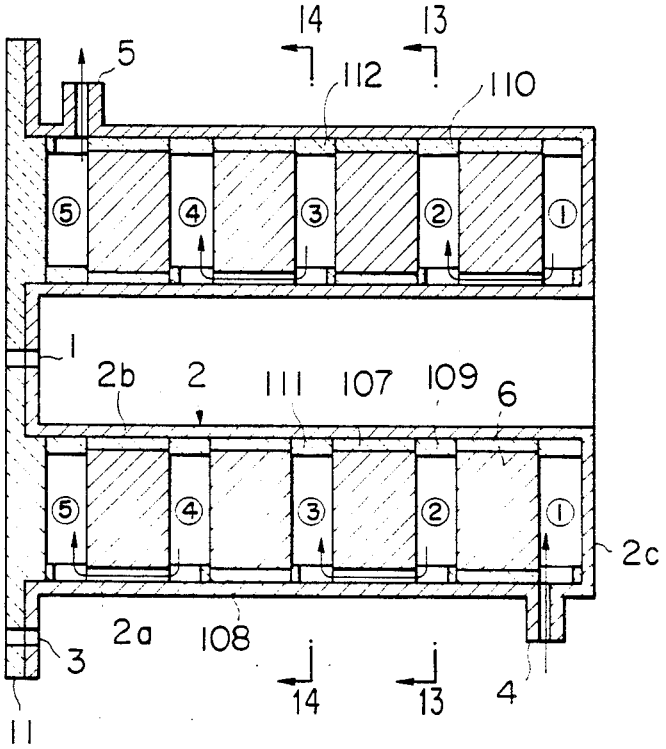
FIG. 12 is a cross-sectional view showing the saturable reactor for high-voltage pulse generating apparatuses according to a still further embodiment of the present invention.

FIG. 12 shows a saturable reactor for high-voltage pulse generating apparatuses according to a still further embodiment of the present invention. In FIG. 12, the same reference numerals are assigned to the same parts as in FIG. 1. Specifically, 1 denotes an input or output terminal, 2 a coaxial cylindrical conductor having an outer wall 2*a*, an inner wall 2*b* and an end wall 2*c* for defining a cavity, 3 an output or input terminal, 4 an inlet for a coolant, 5 an outlet for a coolant, 6 a plurality of wound magnetic cores each constituted by a Co-base amorphous magnetic ribbon, for instance, and an insulating tape such as a polyethylene terephthalate film tape, 11 an insulating member for electrically isolating the input and output terminals 1, 3 and for sealing the cavity defined by the coaxial cylindrical conductor 2, 107 and 108 insulating ring members for fixing the magnetic cores 6 and shutting the flow of a coolant, 109, 110, 111 and 112 insulating coolant guide ring members for keeping the adjacent magnetic cores separate from each other and for guiding the coolant to flow such that the end surfaces of the magnetic cores can be uniformly cooled. In this saturable reactor, the coolant such as cooling oil is introduced into the cavity through the inlet 4, and it flows in the cavity along the course of ①→②→③→④→⑤. While uniformly cooling the end surfaces of each magnetic core 6, the coolant is discharged through the outlet 5 and recycled by a pump (not shown).

Figure 13:
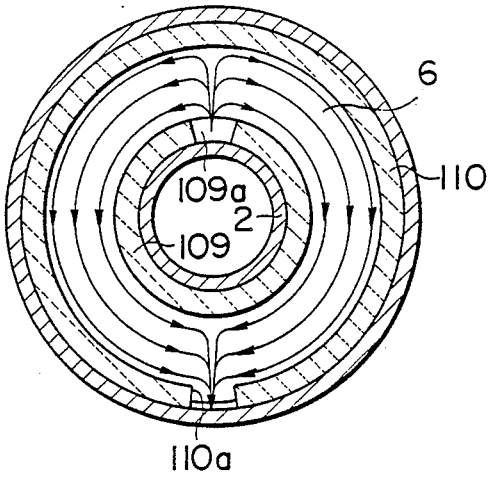
FIG. 13 is a cross-sectional view taken along the line A—A in FIG. 1.

FIG. 13 is a cross-sectional view taken along the line A—A in FIG. 12, showing the relation between the inner insulating coolant guide ring member 109 and the outer insulating coolant guide ring member 110 in a space defined by the adjacent magnetic cores 6. The inner insulating coolant guide ring member 109 and the outer insulating coolant guide ring member 110 respectively have only one notch or opening 109*a*, 110*a*, and the notches 109*a*, 110*a* are located substantially at diametrically opposite positions. In the positions of the notches 109*a*, 110*a* shown in FIG. 13, the coolant flows from the notch 109*a* to the notch 110*a* substantially in a circumferential direction of the magnetic core 6. Accordingly, the end surfaces of each magnetic core 6 are in contact with the coolant for a maximum period of time, meaning that the highest cooling efficiency can be achieved. Incidentally, in FIG. 13, the coolant flows circumferentially from inside to outside.

Figure 21:
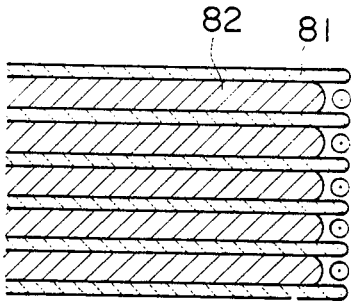
FIG. 21 is partial cross-sectional view showing end portions of the magnetic core of the saturable reactor according to the present invention, which shows the direction of a coolant flow.

FIG. 21 shows the relations of the layer structure of the wound magnetic core and the flow direction of the coolant. In FIG. 21, 81 denotes an insulating layer and 82 a magnetic ribbon layer, and the symbol "⊙" means that the coolant flows upwardly with respect to a paper plane. As is clear from FIG. 21, the coolant can smoothly contact with the end surfaces of the magnetic ribbon layers 82.

Figure 14:
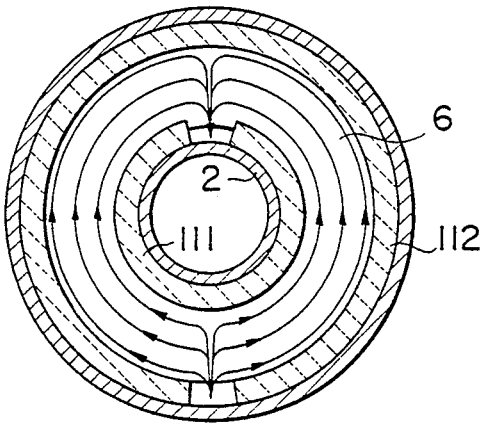
FIG. 14 is a cross-sectional view taken along the line B—B in FIG. 1.

FIG. 14 is a cross-sectional view taken along the line B—B in FIG. 12. FIG. 14 shows the flow direction of the coolant in a space labeled as ③ in FIG. 12. Specifically, the coolant flows circumferentially from outside to inside, just opposite to the case of FIG. 13. Like this, the coolant flows through all spaces between the magnetic cores 6 in substantially the longest course of ①→②→③→④→⑤.

With a silicone oil having a viscosity of 5 $mm^2/S$ as a cooling oil, the variation of a compression ratio with time was measured on the saturable reactor for high-voltage pulse generating apparatuses in this embodiment shown in FIG. 12 and the conventional one shown in FIG. 30. In this measurement, both saturable reactors were assembled in a KrF excimer laser apparatus including the circuit shown in FIG. 27. The results are shown in Table 9.

TABLE 9

| | Compression Ratio | | | | |
|---|---|---|---|---|---|
| | At Start | After 30 sec | After 60 sec | After 120 sec | After 300 sec |
| Saturable Reactor of the Present Invention* | 5.5 | 5.4 | 5.3 | 5.1 | 5.1 |
| Conventional Saturable Reactor** | 5.5 | 5.2 | 4.7 | 4.3 | 4.1 |

Note:
*Shown in FIG. 12.
**Shown in FIG. 30.

Experimental Conditions:
Input: $V_i$=DC 30 kV.
Capacitance=15 nF for capacitors 206, 207, 209.
Saturable reactor (in FIGS. 12 and 30)
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m
Repetition rate: 3 kHz In the present invention, extremely small variation of the compression ratio with time is obtained, so that the saturable reactor shows sufficient characteristics for practical use. On the other hand, in the conventional saturable reactor shown in FIG. 30, the operational magnetic flux density ΔB of the magnetic cores decreases under the influence of temperature increase caused by the magnetic core loss, so that the compression ratio is drastically decreased.

With the same apparatuses and the same conditions as in Table 9, the deterioration of properties after repeated operations was evaluated. In this experiment, each saturable reactor was operated for 5 minutes, cooled for a sufficient period and then operated again, and this process was repeated. At the time of each restart, the compression ratio was measured. The results are shown in Table 10.

TABLE 10

| Number of Operation | Compression Ratio | | | | |
|---|---|---|---|---|---|
| | 1 | 10 | 20 | 30 | 100 |
| Saturable Reactor of the Present Invention* | 5.5 | 5.5 | 5.5 | 5.5 | 5.5 |
| Conventional Saturable Reactor** | 5.5 | 5.4 | 5.3 | 5.1 | 4.8 |

Note:
*Shown in FIG. 12.
**Shown in FIG. 30.

Experimental Conditions:
Input: $V_i$=DC 30 kV.
Capacitance=15 nF for capacitors 206, 207, 209.
Saturable reactor (in FIGS. 12 and 30).
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m.
Repetition rate: 3 kHz.
Operation time in each cycle: 5 minutes.

In the present invention, the compression ratio does not depend on the number of operation, while in the conventional saturable reactor, the magnetic properties of the saturable reactor are deteriorated by heat spots generated inside the magnetic cores during the operation.

Figure 15:
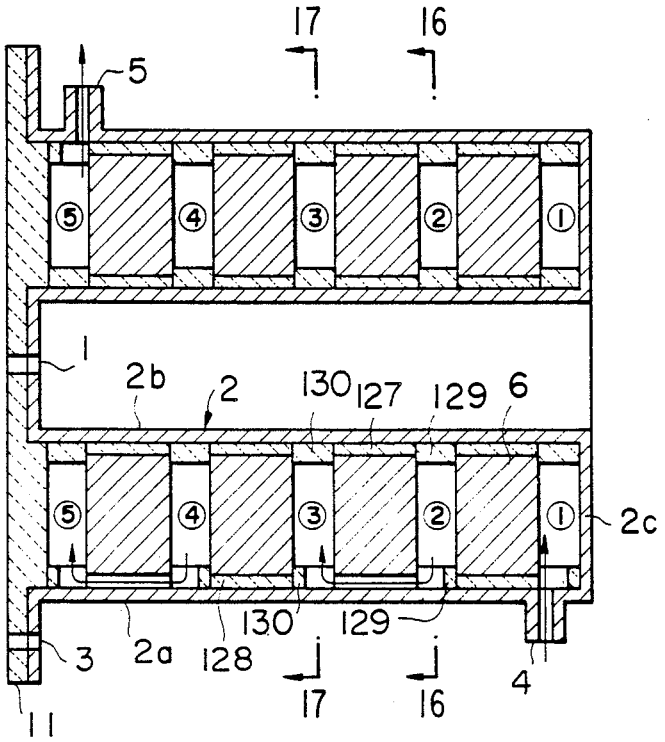
FIG. 15 is a cross-sectional view showing the saturable reactor for high-voltage pulse generating apparatuses according to a still further embodiment of the present invention.

FIG. 15 shows a saturable reactor as a magnetic device for high-voltage pulse generating apparatuses according to a still further embodiment of the present invention. In FIG. 15, the same reference numerals are assigned to the same parts as in FIG. 12. Specifically, 1 denotes an input or output terminal, 2 a coaxial cylindrical conductor having an outer wall **2*a*, an inner wall 2*b* and an end wall 2*c* for defining a cavity, 3 an output or input terminal, 4 an inlet for a coolant, 5 an outlet for a coolant, 6 a plurality of wound magnetic cores each constituted by a Co-base amorphous magnetic ribbon, for instance, and an insulating tape such as a polyethylene terephthalate film tape, 11 an insulating member for electrically isolating the input and output terminals 1, 3 and for sealing the cavity defined by the coaxial cylindrical conductor 2, 127 and 128 insulating ring members for fixing the magnetic cores 6 and shutting the flow of a coolant, 129 and 130 insulating coolant guide ring members for keeping the adjacent magnetic cores separate from each other and for guiding the coolant to flow such that the end surfaces of the magnetic cores 6 can be uniformly cooled by the coolant. In this saturable reactor, a coolant such as cooling oil is introduced into the cavity through the inlet 4, and it flows in the cavity along the course of ①→②→③→④→⑤. While uniformly cooling the end surfaces of each magnetic core 6, the coolant is discharged through the outlet 5** and recycled by a pump (not shown).

Figure 16:
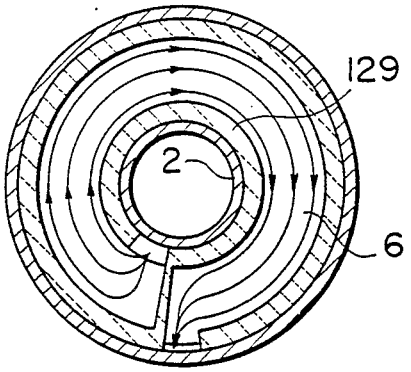
FIG. 16 is a cross-sectional view taken along the line A—A in FIG. 15.
Figure 17:
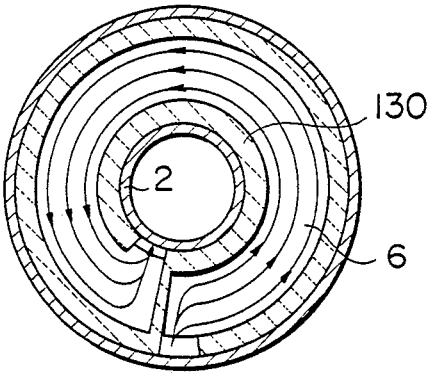
FIG. 17 is a cross-sectional view taken along the line B—B in FIG. 15.

FIG. 16 is a cross-sectional view taken along the line A—A in FIG. 15, showing the insulating coolant guide member 129 which has an inner cylindrical portion and an outer cylindrical portion integrally connected to each other by a radial spacer. Since one notch of the inner cylindrical portion and one notch of the outer cylindrical portion are located near the same radial, position, and since these notches are separated by the radial spacer, the coolant flows substantially along the entire circumference of the magnetic core. In FIG. 16, the coolant flows circumferentially from inside to outside. The insulating coolant guide member 130 shown in FIG. 17 has substantially the same structure as that of the insulating coolant guide member 129 except for the axial direction of the notch. In the insulating coolant guide member 130, the coolant flows circumferentially from outside to inside. Accordingly, the end surfaces of each magnetic core 6 are in contact with the coolant for a maximum period of time, meaning that the highest cooling efficiency can be achieved. Thus, the coolant flows through all spaces between the magnetic cores 6 in substantially the longest course of ①→②→③→④→⑤.

With a silicone oil having a viscosity of 5 $mm^2/S$ as a cooling oil, the variation of a compression ratio with time was measured on the saturable reactor for high-voltage pulse generating apparatuses in this embodiment shown in FIG. 15 and the conventional one shown in FIG. 30. In this measurement, both saturable reactors were assembled in a KrF excimer laser apparatus including the circuit shown in FIG. 27. The results are shown in Table 11.

TABLE 11

| | Compression Ratio | | | | |
|---|---|---|---|---|---|
| | At Start | After 30 sec | After 60 sec | After 120 sec | After 300 sec |
| Saturable Reactor of the Present Invention* | 5.5 | 5.4 | 5.3 | 5.2 | 5.2 |
| Conventional Saturable Reactor** | 5.5 | 5.2 | 4.7 | 4.3 | 4.1 |

Note:
*Shown in FIG. 15.
**Shown in FIG. 30.

Experimental Conditions:
Input: $V_i$=DC 30 kV.
Capacitance=15 nF for capacitors 206, 207, 209.
Saturable reactor (in FIGS. 15 and 30)
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m
Repetition rate: 3 kHz In the present invention, extremely small variation of the compression ratio with time is obtained, so that the saturable reactor shows sufficient characteristics for practical use.

With the same apparatuses and the same conditions as in Table 11, the deterioration of properties after repeated operations was evaluated. In this experiment, each saturable reactor was operated for 5 minutes, cooled for a sufficient period and then operated again, and this process was repeated. At the time of each restart, the compression ratio was measured The results are shown in Table 12.

TABLE 12

| Number of Operation | Compression Ratio | | | | |
|---|---|---|---|---|---|
| | 1 | 10 | 20 | 50 | 100 |
| Saturable Reactor of the Present Invention* | 5.5 | 5.5 | 5.5 | 5.5 | 5.5 |
| Conventional Saturable Reactor** | 5.5 | 5.4 | 5.3 | 5.1 | 4.8 |

Note:
*Shown in FIG. 15.
**Shown in FIG. 30.

Experimental Conditions:
Input: $V_i$=DC 30 kV.
Capacitance=15 nF for capacitors 206, 207, 209.
Saturable reactor (in FIGS. 15 and 30).
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m.
Repetition rate: 3 kHz.
Operation time in each cycle: 5 minutes.

In the present invention, the compression ratio does not depend on the number of operation, while in the conventional saturable reactor, the magnetic properties of the saturable reactor are deteriorated by heat spots generated inside the magnetic cores during the operation.

Figure 18:
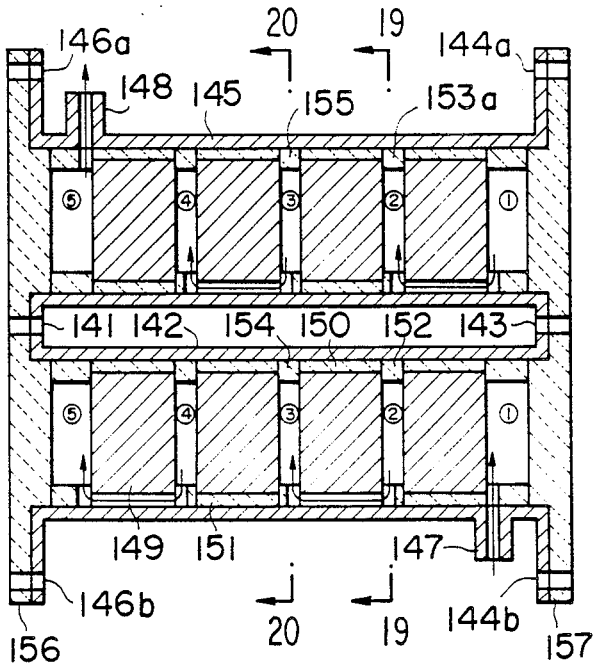
FIG. 18 is a cross-sectional view showing the saturable reactor for high-voltage pulse generating apparatuses according to a still further embodiment of the present invention.

FIG. 18 shows a saturable reactor as a magnetic device for high-voltage pulse generating apparatuses according to a still further embodiment of the present invention. In FIG. 18, 141 denotes an input terminal, 142 an inner cylindrical conductor with an oval or race track cross section, 143 an output terminal, 144*a*, 144*b* ground terminals, 145 an outer cylindrical conductor with an oval cross section, 146*a*, 146*b* ground terminals, 147 an inlet for a coolant, 148 an outlet for a coolant, 149 a plurality of wound magnetic cores in the form of a race track each constituted by a Co-base amorphous magnetic ribbon, for instance, and an insulating tape such as a polyethylene terephthalate film tape, 150, 151 insulating ring members each having a path for permitting the coolant to pass therethrough, 152, 153, 154, 155 insulating coolant guide ring members for guiding the coolant to flow circumferentially along the end surfaces of the magnetic cores, 156, 157 insulating seal members for electrically isolating the two cylindrical conductors 142, 145 and for sealing the cavity defined by the coaxially disposed cylindrical conductors 142, 145. In this saturable reactor, a coolant such as cooling oil is introduced into the cavity through the inlet 147, and it flows in the cavity along the course of ①→②→③→④→⑤. While uniformly cooling the end surfaces of each magnetic core 149, the coolant is discharged through the outlet 148 and recycled by a pump (not shown).

Figure 19:
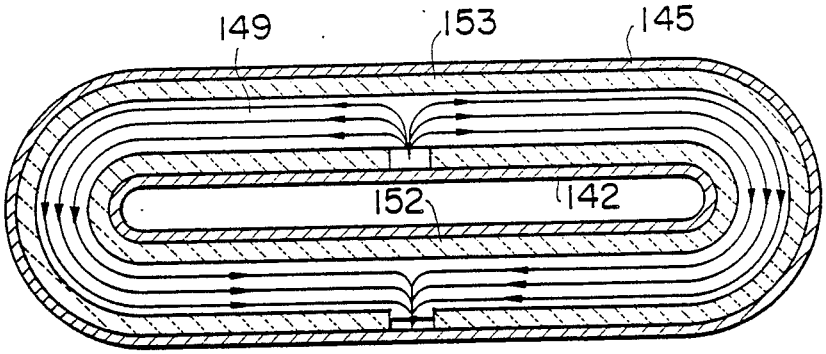
FIG. 19 is a cross-sectional view taken along the line A—A in FIG. 18.
Figure 20:
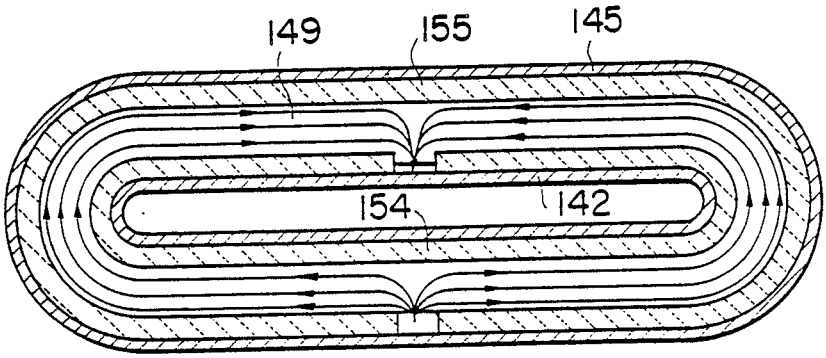
FIG. 20 is a cross-sectional view taken along the line B—B in FIG. 18.

FIG. 19 is a cross-sectional view taken along the line A—A in FIG. 18, showing an inner insulating coolant guide ring member 152 which has a notch for permitting the coolant to pass therethrough, and an outer insulating coolant guide ring member 153 which has a notch for permitting the coolant to pass therethrough. Since these notches are located diametrically oppositely, the coolant flows substantially along the entire circumference of the magnetic core. In FIG. 19, the coolant flows circumferentially from inside to outside. In FIG. 20, each of the inner and outer coolant guide ring members 154, 155 has a notch, and the two notches are located diametrically oppositely as in FIG. 19. However, their notches are directed just oppositely to those of the coolant guide ring members 152, 153. Therefore, in FIG. 20, the coolant flows circumferentially from outside to inside. Accordingly, the end surfaces of each magnetic core 149 are in contact with the coolant for a maximum period of time, meaning that the highest cooling efficiency can be achieved. Thus, the coolant flows through all spaces between the magnetic cores 149 in substantially the longest course of ①→②→③→④→⑤.

With a silicone oil having a viscosity of 5 $mm^2/S$ as a cooling oil, the variation of a compression ratio with time was measured on the saturable reactor for high-voltage pulse generating apparatuses in this embodiment shown in FIG. 18 and the conventional one shown in FIG. 30. In this measurement, both saturable reactors were assembled in a KrF excimer laser apparatus including the circuit shown in FIG. 27. The results are shown in Table 13.

TABLE 13

| | Compression Ratio | | | | |
|---|---|---|---|---|---|
| | At Start | After 30 sec | After 60 sec | After 120 sec | After 300 sec |
| Saturable | 5.5 | 5.4 | 5.3 | 5.1 | 5.1 |

TABLE 13-continued

| | Compression Ratio | | | | |
|---|---|---|---|---|---|
| | At Start | After 30 sec | After 60 sec | After 120 sec | After 300 sec |
| Reactor of the Present Invention* | | | | | |
| Conventional Saturable Reactor** | 5.5 | 5.3 | 5.0 | 4.6 | 4.5 |

Note:
*Shown in FIG. 18.
**Shown in FIG. 30.

Experimental Conditions:
Input: $V_i$=DC 30 kV.
Capacitance 30 nF for capacitors 206 ,207, 209.
Saturable reactor (in FIGS. 18 and 30)
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: 1.0 m
Repetition rate: 3 kHz In the present invention, extremely small variation of the compression ratio with time is obtained, so that the saturable reactor shows sufficient characteristics for practical use.

With the same apparatuses and the same conditions as in Table 13, the deterioration of properties after repeated operations was evaluated. In this experiment, each saturable reactor was operated for 5 minutes, cooled for a sufficient period and then operated again, and this process was repeated. At the time of each restart, the compression ratio was measured. The results are shown in Table 14.

TABLE 14

| Number of Operation | Compression Ratio | | | | |
|---|---|---|---|---|---|
| | 1 | 10 | 20 | 30 | 100 |
| Saturable Reactor of the Present Invention* | 5.5 | 5.5 | 5.5 | 5.5 | 5.5 |
| Conventional Saturable Reactor** | 5.5 | 5.5 | 5.4 | 5.3 | 5.0 |

Note:
*Shown in FIG. 18.
**Shown in FIG. 30.

Experimental Conditions:
Input: $V_i$=DC 30 kV.
Capacitance=30 nF for capacitors 206, 207, 209.
Saturable reactor (in FIGS. 18 and 30).
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: 1.0 m.
Repetition rate: 3 kHz.
Operation time in each cycle: 5 minutes.

In the present invention, the compression ratio does not depend on the number of operation, while in the conventional saturable reactor, the magnetic properties of the saturable reactor are deteriorated by heat spots generated inside the magnetic cores during the operation.

Figure 22:
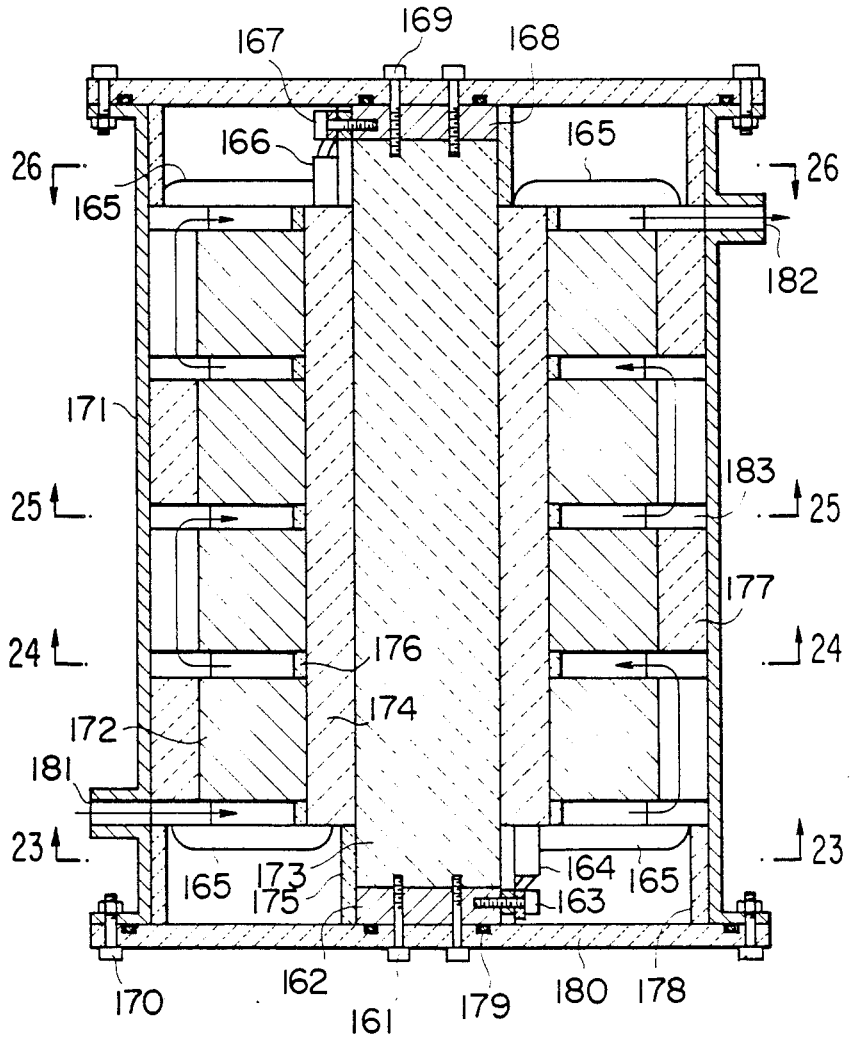
FIG. 22 is a cross-sectional view showing a saturable reactor according to a still further embodiment of the present invention.

FIG. 22 shows a saturable reactor as a magnetic device for high-voltage pulse generating apparatuses according to a still further embodiment of the present invention. This saturable reactor comprises a cylindrical casing 171 and a pair of insulating seal plates 180, 180 fixed to the cylindrical casing 171 by bolts 170. Each insulating seal plate 180 is provided with two terminals 161 or 169. Where the terminals 161 are input terminals, the terminals 169 are output terminals and vice versa. The terminals 161 are connected to a conductive disc plate 162 to which a terminal 163 is threaded. Likewise, the terminals 169 are connected to a conductive disc plate 168 to which a terminal 167 is threaded.

An insulating cylindrical core 173 is disposed in the center of the cylindrical casing 171, and both ends of the insulating cylindrical core 173 are fixed to the conductive disc plates 162, 168 by the terminals 161, 169 serving as threads. Provided around the insulating cylindrical core 173 is an insulating cylindrical member 174 extending along substantially the entire length of the insulating cylindrical core 173. The insulating cylindrical member 174 is fixed by a pair of insulating rings 175 each positioned between the end of the insulating cylindrical member 174 and the insulating disc plates 162, 168.

A plurality of wound magnetic cores 172 are fixed to the insulating cylindrical member 174, and each of their outer surfaces is fixed to the cylindrical casing 171 via an outer insulating ring member 177 provided with an opening or a notch. A notch of one outer insulating ring member 177 is positioned diametrically opposite to a notch of the adjacent outer insulating ring member. Further, an inner insulating ring spacer 176 and an outer insulating ring spacer 183 are disposed between the adjacent wound magnetic cores 172, and the outer insulating ring spacer 183 is provided with a pair of openings or notches diametrically opposite to each other. The outer insulating ring spacers 183 are fixed by a pair of ring members 178 each positioned between the outer insulating ring spacer and the insulating disc plate 180.

Figure 23:
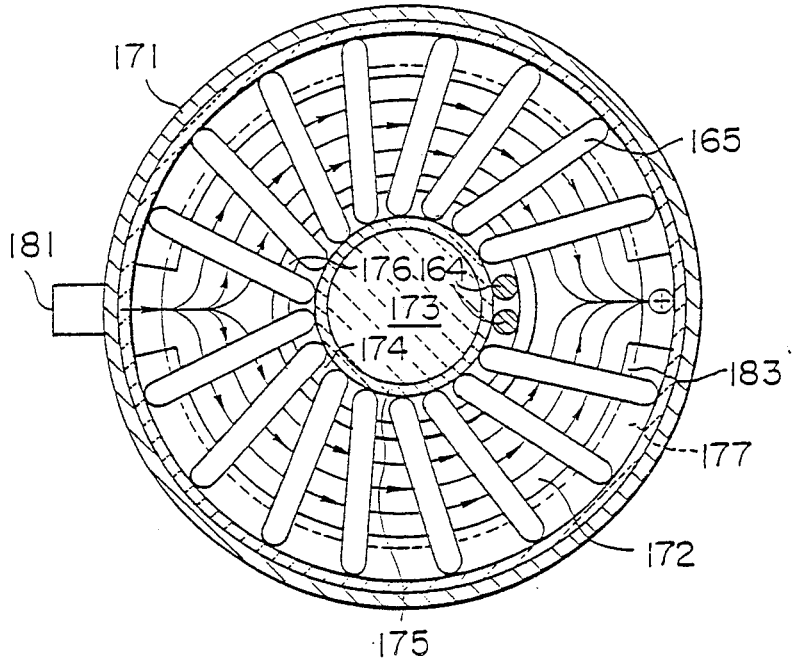
FIG. 23 is a cross-sectional view taken along the line A—A in FIG. 22.
Figure 24:
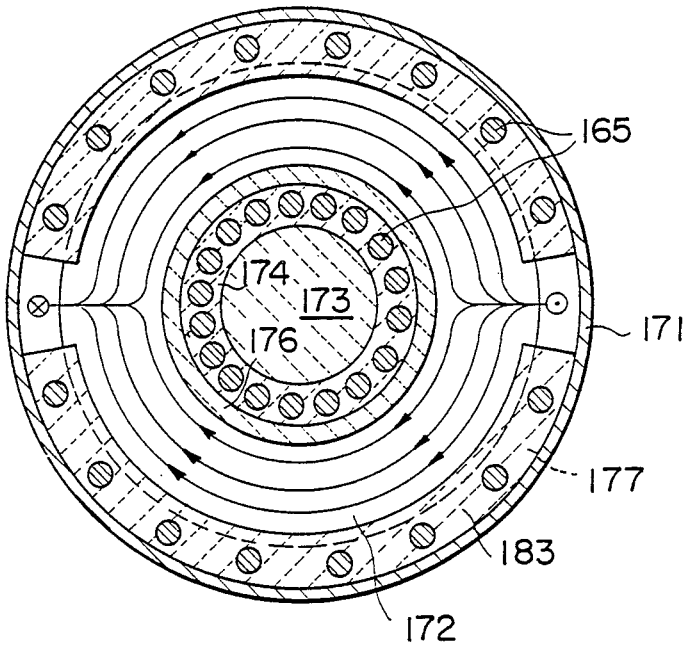
FIG. 24 is a cross-sectional view taken along the line B—B in FIG. 22.
Figure 25:
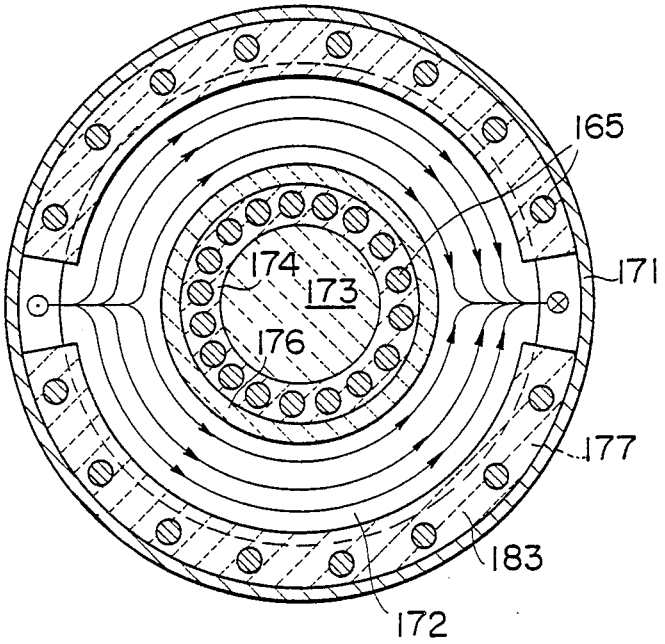
FIG. 25 is a cross-sectional view taken along the line C—C in FIG. 22.
Figure 26:
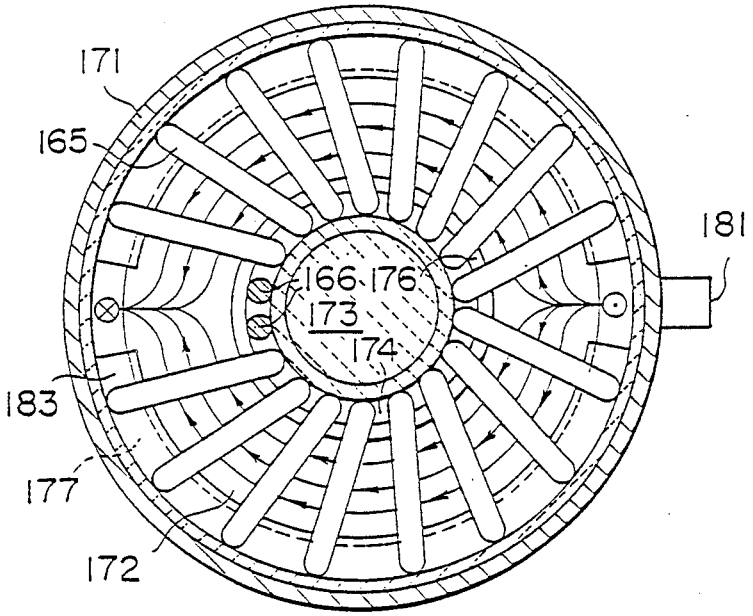
FIG. 26 is a cross-sectional view taken along the line D—D in FIG. 22.
Figure 28:
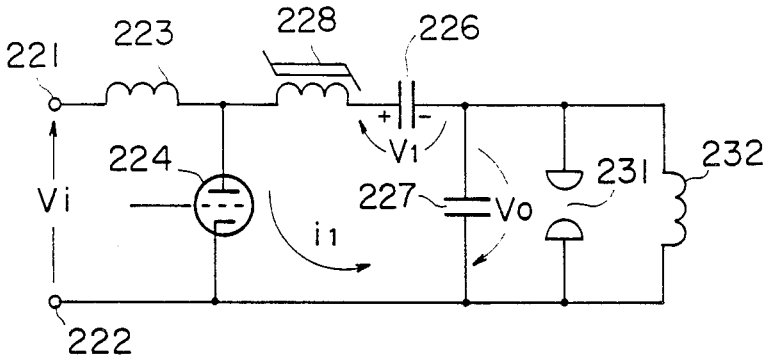
FIG. 28 PRIOR ART
FIG. 28 is a schematic view showing an exciting circuit for an excimer laser which has a magnetic assist-type high-voltage pulse generating circuit.
Figure 29:
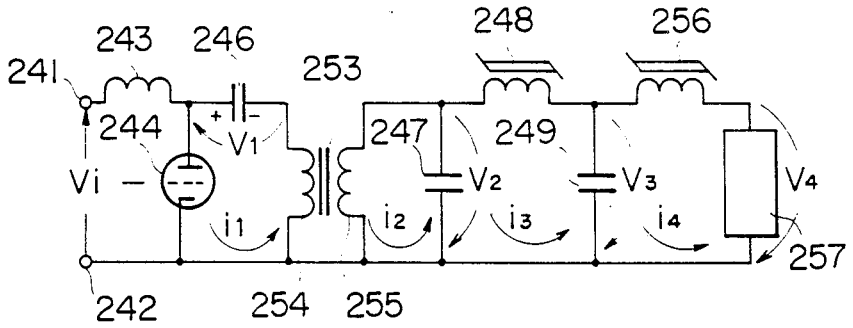
FIG. 29 PRIOR ART
FIG. 29 is a schematic view showing a high-voltage pulse generating circuit for a linear induction accelerator.

As shown in FIG. 24, both the insulating cylindrical member 174 and the insulating ring member 177 have a plurality of holes extending axially, and a wire 165 for winding penetrates through each hole. It should be noted that a pair of wires 165, 165 are used for winding, and each wire 165 is wound around the wound magnetic core 172 in a half circle (180°). As shown in FIGS. 22 and 23, ends 164, 164 (only one is shown) of the two wires 165, 165 are connected to the terminal 163, and the other ends 166, 166 (only one is shown) are connected to the terminal 167.

The cylindrical casing 171 is preferably made of a conductive material so that it can serve as a ground terminal. The cylindrical casing 171 is provided with an inlet 181 for a coolant and an outlet 182 for a coolant.

In the saturable reactor thus constructed, the coolant flows as shown by the arrows in FIGS. 22–26. Specifically, as shown in FIGS. 22–26, the coolant is introduced into a space between the insulating disc plate 180 and the wound magnetic core 172 and flows circumferentially therein. It passes through the notch of the outer insulating ring spacer 183 and the notch of the outer insulating ring member 177 and introduced into the next space between the adjacent wound magnetic cores 172. It also flows circumferentially in the next space, and this process is repeated. The coolant is finally discharged through the outlet 182.

In this saturable reactor, since wires penetrate through a plurality of holes axially extending in the insulating cylindrical member 174 and the outer insulating ring members 177, a plurality of turns can be obtained without interfering the flow of the coolant. In addition, since the coolant flows circumferentially from one notch of the outer insulating ring spacer 183 to one notch of the same outer insulating ring spacer 183 in each space, the end surfaces of the wound magnetic cores are efficiently cooled.

With a silicone oil having a viscosity of 5 $mm^2/S$ as a cooling oil, the variation of a compression ratio with time was measured on the saturable reactor for high-voltage pulse generating apparatuses in this embodiment shown in FIG. 22 and the conventional one having the same structure as shown in FIG. 22 except that it does not have a coolant guide means composed of outer insulating ring members 177 and outer insulating ring spacers 183. In this measurement, both saturable reactors were assembled in a TEA (transversely excited atmospheric pressure)-$CO_2$ laser apparatus including the circuit shown in FIG. 27. The results are shown in Table 15.

TABLE 15

| | Compression Ratio | | | | |
|---|---|---|---|---|---|
| | At Start | After 30 sec | After 60 sec | After 120 sec | After 300 sec |
| Saturable Reactor of the Present Invention* | 6.1 | 6.1 | 6.0 | 6.0 | 5.9 |
| Conventional Saturable Reactor** | 6.1 | 5.9 | 5.7 | 5.5 | 5.3 |

Note:
*Shown in FIG. 22.
**Shown in FIG. 22 except for the coolant guide means.

Experimental Conditions:
Input: $V_i$=DC 30 kV.
Capacitance=30 nF for capacitors 206, 207, 209.
Both saturable reactors
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m
Repetition rate: 3 kHz In the present invention, extremely small variation of the compression ratio with time is obtained, so that the saturable reactor shows sufficient characteristics for practical use.

With the same apparatuses and the same conditions as in Table 15, the deterioration of properties after repeated operations was evaluated. In this experiment, each saturable reactor was operated for 5 minutes, cooled for a sufficient period and then operated again, and this process was repeated. At the time of each restart, the compression ratio was measured. The results are shown in Table 16.

TABLE 16

| Number of Operation | Compression Ratio | | | | |
|---|---|---|---|---|---|
| | 1 | 10 | 20 | 30 | 100 |
| Saturable Reactor of the Present Invention* | 6.1 | 6.1 | 6.1 | 6.1 | 6.0 |
| Conventional Saturable Reactor** | 6.1 | 6.1 | 6.0 | 5.8 | 5.7 |

TABLE 16-continued

| Number of Operation | Compression Ratio | | | | |
|---|---|---|---|---|---|
| | 1 | 10 | 20 | 30 | 100 |

Note:
*Shown in FIG. 22.
**Shown in FIG. 22 except for the coolant guide means.

Capacitance=30 nF for capacitors 206, 207, 209.
Both saturable reactors.
Magnetic ribbon of each magnetic core:
Co-base amorphous magnetic ribbon.
The number of magnetic cores: 4.
Effective cross section=$1.2\times10^{-3}$ $m^2$ for each magnetic core.
Mean magnetic path length: $380\times10^{-3}$ m
Repetition rate: 3 kHz.
Operation time in each cycle: 5 minutes.

In the present invention, the compression ratio does not depend on the number of operation, while in the conventional saturable reactor, the magnetic properties of the saturable reactor are deteriorated by heat spots generated inside the magnetic cores during the operation.

As described above in detail, since the wound magnetic cores are effectively cooled in the present invention, the temperature increase of the magnetic core, particularly heat spots can be prevented.

Particularly when the wound magnetic cores are constituted by amorphous magnetic ribbons laminated with insulating layers, the deterioration of their magnetic properties is irreversible. Accordingly, it is extremely important to prevent the generation of the heat spots inside the magnetic cores. Further, although the magnetic ribbon laminated with the insulating layer can hardly be cooled from its circumferential surface, the wound magnetic core can be easily cooled from its axial ends because the side ends of the magnetic ribbon are exposed at the axial ends of the wound magnetic core. Therefore, the manner of flowing the coolant in the magnetic device according to the present invention is extremely effective to achieve a high cooling efficiency.

Because of the above structural features, the magnetic device of the present invention is less susceptible to deterioration in magnetic properties even after high repetition rate operations. Therefore, it can be repeatedly used for a long period of time.

The magnetic devices of the present invention can be utilized not only as saturable reactors but also as transformers, accelerator cells in linear induction accelerators, choke coils, etc. for achieving the same effects.

What is claimed is:

1. A magnetic device for high-voltage pulse generating apparatuses comprising:

(a) at least one cylindrical conductor for defining a cavity, said cylindrical conductor being provided with input and output terminals and an inlet and an outlet for a coolant;

(b) at least one sealing member fixed to said cylindrical conductor;

(c) a plurality of wound magnetic cores each composed of a magnetic ribbon laminated with an insulating layer, said wound magnetic cores being fixed to said cylindrical conductor with such an interval as to provide a certain space between the adjacent wound magnetic cores; and (d) an outer ring member disposed between each of said magnetic cores and said cylindrical conductor and having at least one path for permitting said coolant to flow therethrough, whereby said coolant flows in a radial or circumferential direction of each wound magnetic core in each space between the adjacent wound magnetic cores.

2. A magnetic device for high-voltage pulse generating apparatuses comprising:

(a) a coaxial cylindrical conductor having an inner cylindrical wall and an outer cylindrical wall for defining a cavity therebetween, said coaxial cylindrical conductor being provided with input and output terminals and an inlet and an outlet for a coolant;

(b) an insulating sealing member fixed to said coaxial cylindrical conductor for sealing said cavity; and (c) a plurality of wound magnetic cores each composed of a magnetic ribbon laminated with an insulating layer, said wound magnetic cores being fixed in said cavity via outer insulating ring members and inner insulating ring members with such an interval as to provide a certain space between the adjacent wound magnetic cores, said inner and outer insulating ring members alternately having paths for permitting said coolant to flow therethrough, whereby said coolant flows in a radial direction of each wound magnetic core in each space between the adjacent wound magnetic cores.

3. The magnetic device for high-voltage pulse generating apparatuses according to claim 2, further comprising inner and outer insulating coolant guide members disposed alternately in each space between the adjacent wound magnetic cores, each of said inner and outer insulating coolant guide members having a plurality of notches for permitting said coolant to pass therethrough.

4. The magnetic device for high-voltage pulse generating apparatuses according to claim 2, wherein said magnetic ribbon is an amorphous magnetic ribbon.

5. A magnetic device for high-voltage pulse generating apparatuses comprising:

(a) a coaxial cylindrical conductor having an inner cylindrical wall and an outer cylindrical wall for defining a cavity therebetween, said coaxial cylindrical conductor being provided with input and output terminals and an inlet and an outlet for a coolant;

(b) an insulating sealing member fixed to said coaxial cylindrical conductor for sealing said cavity:

(c) a plurality of magnetic core assemblies each composed of a plurality of wound magnetic cores disposed radially with a certain gap between radially adjacent wound magnetic cores, each of said wound magnetic cores being composed of a magnetic ribbon laminated with an insulating layer, and said magnetic core assemblies being fixed in said cavity with such an interval as to provide a certain space between axially adjacent magnetic core assemblies: and (d) a plurality of disc-shaped insulating coolant guide members each having a plurality of apertures, said apertures being positioned between radially adjacent gaps of said magnetic core assemblies, whereby said coolant flows in a radial direction of each wound magnetic core in each space between the axially adjacent magnetic core assemblies.

6. The magnetic device for high-voltage pulse generating apparatuses according to claim 5, wherein said magnetic ribbon is an amorphous magnetic ribbon.

7. A magnetic device for high-voltage pulse generating apparatuses comprising:

(a) a coaxial cylindrical conductor having an inner cylindrical wall and an outer cylindrical wall for defining a cavity therebetween, said coaxial cylindrical conductor being provided with input and output terminals and an inlet and an outlet for a coolant;

(b) an insulating sealing member fixed to said coaxial cylindrical conductor for sealing said cavity;

(c) a plurality of wound magnetic cores each composed of a magnetic ribbon laminated with an insulating layer, said wound magnetic cores being fixed in said cavity via outer insulating ring members and inner insulating ring members with such an interval as to provide a certain space between the adjacent wound magnetic cores, said inner and outer insulating ring members alternately having paths for permitting said coolant to flow therethrough: and (d) inner and outer insulating coolant guide members disposed in each space between the adjacent wound magnetic cores, each of said inner and outer insulating coolant guide members having a notch for permitting said coolant to pass therethrough, said notches of the inner and outer insulating coolant guide members being located in each space substantially at diametrically opposite positions, whereby said coolant flows along the circumferential direction of each wound magnetic core.

8. The magnetic device for high-voltage pulse generating apparatuses according to claim 7, wherein the two notches of said inner and outer insulating coolant guide members are located near a radius of said wound magnetic core, and a separator plate is integrally provided between said inner insulating coolant guide member and said outer insulating coolant guide member to separate the two notches in each space, whereby the coolant flows substantially along the circumferential direction of each wound magnetic core in each space.

9. A magnetic device for high-voltage pulse generating apparatuses comprising:

(a) inner and outer cylindrical conductors disposed coaxially for defining a cavity therebetween, said outer cylindrical conductor being provided with input and output terminals and an inlet and an outlet for a coolant;

(b) a pair of insulating sealing members fixed to said inner and outer cylindrical conductors for sealing said cavity;

(c) a plurality of wound magnetic cores each composed of a magnetic ribbon laminated with an insulating layer, said wound magnetic cores being fixed in said cavity via outer insulating ring members and inner insulating ring members with such an interval as to provide a certain space between the adjacent wound magnetic cores, said inner and outer insulating ring members alternately having paths for permitting said coolant to flow therethrough: and (d) inner and outer insulating coolant guide members disposed in each space between the adjacent wound magnetic cores, each of said inner and outer insulating coolant guide members having a notch for permitting said coolant to pass therethrough, said notches of the inner and outer insulating coolant guide members being located in each space substantially at diametrically opposite positions, whereby said coolant flows along the circumferential direction of each wound magnetic core.

10. A magnetic device for high-voltage pulse generating apparatuses comprising:

(a) a cylindrical casing provided with an inlet and an outlet for a coolant:

(b) a pair of insulating plates fixed to both ends of said cylindrical casing for defining a cavity, each of said insulating plates being provided with at least one terminal for a winding;

(c) an inner insulating cylindrical member extending axially in said cylindrical casing and having a plurality of holes extending axially:

(d) a plurality of wound magnetic cores each composed of a magnetic ribbon laminated with an insulating layer, said wound magnetic cores being fixed to said inner insulating cylindrical member with a certain space between the adjacent wound magnetic cores;

(e) a plurality of outer insulating ring members each disposed between said wound magnetic core and said cylindrical conductor, said outer insulating ring members being provided with a plurality of holes extending axially:

(f) a plurality of outer insulating ring spacers each having a pair of notches positioned diametrically opposite to each other: and (g) at least one winding having a plurality of turns extending through said holes of said inner insulating cylindrical member and said outer insulating ring members, whereby a coolant introduced into said cavity through said inlet flows circumferentially from one notch to the other notch of said outer insulating ring spacer in each space between the adjacent wound magnetic cores.

11. The magnetic device for high-voltage pulse generating apparatuses according to claim 10, wherein said cylindrical casing is made of a conductive material such that it serves as a ground terminal.

* * * * *